US006294974B1

(12) United States Patent
Fukumoto

(10) Patent No.: US 6,294,974 B1
(45) Date of Patent: Sep. 25, 2001

(54) IGNITION COIL FOR INTERNAL COMBUSTION ENGINE, AND METHOD OF MANUFACTURING AN IGNITION COIL

(75) Inventor: Koji Fukumoto, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/236,469

(22) Filed: Jan. 25, 1999

(30) Foreign Application Priority Data

Jan. 23, 1998 (JP) ..... 10-011431
Aug. 10, 1998 (JP) ..... 10-226047

(51) Int. Cl.[7] ..... H01F 27/02

(52) U.S. Cl. ..... 336/107; 336/96; 336/185; 336/212; 336/234

(58) Field of Search ..... 336/96, 110, 107, 336/178, 212, 225–232; 123/634, 635

(56) References Cited

U.S. PATENT DOCUMENTS

| | | | | |
|---|---|---|---|---|
| 791,423 | * | 5/1905 | Ihlder | 336/212 |
| 861,029 | * | 7/1907 | Hall | 336/212 |
| 3,480,229 | * | 11/1969 | D'Entremond | 336/198 |
| 3,657,677 | * | 4/1972 | Hunt et al. | 336/96 |
| 3,732,514 | * | 5/1973 | Sato | 336/172 |
| 4,866,409 | * | 9/1989 | Umezaki | 336/96 |
| 5,296,830 | * | 3/1994 | Tamada et al. | 336/192 |
| 5,359,313 | * | 10/1994 | Watanabe et al. | 336/178 |
| 5,430,424 | * | 7/1995 | Sato et al. | 336/200 |

FOREIGN PATENT DOCUMENTS

| | | |
|---|---|---|
| 61-231708 | 10/1986 | (JP) . |
| U-61-182020 | 11/1986 | (JP) . |
| 62-287609 | 12/1987 | (JP) . |
| 2-252217 | 10/1990 | (JP) . |
| 6-5445 | 1/1994 | (JP) . |
| B2-6-11012 | 2/1994 | (JP) . |
| B2-6-9178 | 2/1994 | (JP) . |
| 7-147213 | 6/1995 | (JP) . |
| 7-245217 | 9/1995 | (JP) . |
| 8-111328 | 4/1996 | (JP) . |
| 9-126111 | 5/1997 | (JP) . |
| 9-144639 | 6/1997 | (JP) . |
| 9-162046 | 6/1997 | (JP) . |
| 9-306757 | 11/1997 | (JP) . |

* cited by examiner

*Primary Examiner*—Lincoln Donovan
*Assistant Examiner*—Tuyen Nguyen
(74) *Attorney, Agent, or Firm*—Oliff & Berridge, PLC.

(57) ABSTRACT

In a first embodiment, an ignition coil includes a disk-shaped primary coil section having a primary coil winding wound thereon and a disk-shaped secondary coil section having a secondary coil winding wound thereon, the primary coil section and secondary coil section facing each other. A core of each winding is aligned with each other to form a coil member. The coil member has a thickness parallel to the thickness direction of the primary and secondary coil sections of from about 10 mm to about 25 mm. The coil member has radial core sections installed on its lower and upper surfaces and is accommodated inside a case member and fixed to the case member by insulation resin injected into the case member. In a second embodiment, a coil winding is wound between upper and lower flange portions of a primary coil winding seat. The axial width of the coil winding is substantially equal to the interval between the pair of flanges.

5 Claims, 22 Drawing Sheets

IGNITION COIL FOR INTERNAL COMBUSTION ENGINE, AND METHOD OF MANUFACTURING AN IGNITION COIL

BACKGROUND OF THE INVENTION

1. Field of Invention

The present invention relates to an ignition coil for an internal combustion engine for use in a vehicle or the like, and to a method of manufacturing the ignition coil for an internal combustion engine.

2. Description of Related Art

It is known to provide an independent ignition type-ignition coil for each cylinder of an internal combustion engine. One ignition coil of this kind is shown in FIGS. 20 and 21 and is of the so-called upward-set type in which a casing 116 is installed on an opening of a plug hole Ha formed in a cylinder head H of an internal combustion engine.

The casing 116 accommodates a coil 114 of a concentric type including a primary coil section 111 with an enamel wire wound on the periphery of a magnetic core 110 and a secondary coil section 112 with an enamel wire wound on the periphery of the primary coil section 111, with the magnetic core 110 being kept horizontal. A high secondary voltage generated in the secondary coil section 112 of the coil 114 is applied to an ignition plug P positioned at the bottom of the plug hole Ha through a connection member 118 accommodated inside the plug hole Ha.

In recent years, there has been a growing demand for reduction of the height of the part of the ignition coil projecting from the cylinder head H. This is because when the height of this projecting part is large, as shown in FIGS. 20 and 21, it may interfere with suction and exhaust component parts accommodated inside the engine room.

To overcome this problem, as shown in FIG. 22, a so-called in-hole type ignition coil has been proposed. This has a concentric-type coil 103 including a primary coil section 101 with an enamel wire wound on the periphery of a rod-shaped magnetic core 100 and a secondary coil section 102 with an enamel wire wound on the periphery of the primary coil section 101 (or the secondary coil section 102 is formed on the periphery of the magnetic core 100, and the primary coil section 101 is formed on the periphery of the secondary coil section 102). A plug hole Ha accommodates the coil 103. A high secondary voltage generated in the secondary coil section 102 is applied to an ignition plug P positioned at the bottom of the plug hole Ha through a connection member 108 accommodated inside the plug hole Ha.

In this type of ignition coil, because the coil 103 is accommodated inside the plug hole Ha, it is possible to reduce the height of a part 112 projecting from the plug hole Ha.

However, generally, the inner diameter of the plug hole Ha is as small as 23–24 mm. Thus, in the ignition coil shown in FIG. 22, there are restrictions on the thickness of the enamel wire forming the primary coil section 101 and the secondary coil section 102, the number of turns of the enamel wire, and the layout of the magnetic core 100. Thus, it is impossible for the ignition coil to generate a sufficiently great secondary energy.

In particular, in recent years, the direct fuel injection type of internal combustion engine has been rapidly widely adopted. In this type of engine, the ignition coil is required to generate large secondary energy in order to ignite a gas mixture in the cylinder. The ignition coil shown in FIG. 22 is incapable of satisfying such a demand to a sufficient extent. Another problem is that, because the coil 103 is accommodated in the narrow and closed plug hole Ha, the ignition coil is inferior in heat-radiating performance.

In order to overcome the problem the present inventors have devised, but not made public, an ignition coil, such as is shown in FIG. 23, including a coil 124 having a primary coil section 121 and a secondary coil section 122 formed on the periphery of the primary coil section 121. The coil 124 is of concentric type and laterally flat. The coil 124 is installed on a plug hole Ha (e.g., see FIGS. 20 and 22), with the lateral (flat) direction being horizontal. However, it has been revealed that in order to secure a secondary energy having the required magnitude, it is necessary to considerably increase the number of turns of an enamel wire forming the primary and secondary coil sections 121 and 122. When the number of turns of the enamel wire is increased, the ignition coil becomes large radially. Consequently, the ignition coils interfere with each other when assembled adjacent to each other on the engine head.

In a known kind of ignition coil for an internal combustion engine, an enamel wire of circular cross-section is used as a coil winding to be wound on a primary coil winding seat and a secondary coil winding seat.

FIGS. 31 and 32 show conventional methods of winding such an enamel wire of circular cross-section on the primary and secondary coil winding seats.

FIG. 31 shows a cross-section of a coil in which a coil winding 410 such as an enamel wire having a diameter of 0.5 mm is wound 80 times between a pair of flange portions 402 of a primary coil winding seat 404. In this method, the wire of the coil winding 410 is wound between the two flange portions 402. The wire is wound such that, as viewed in cross-section, the winding displays columns of four circles (each circle being a cross-section of the wire), each circle of a column being at the same level as a respective circle of an adjacent column.

FIG. 32 shows a cross-section of a coil in which a coil winding 410 such as an enamel wire having a diameter of 0.5 mm is wound 81 times between a pair of the flange portions 402 of the primary coil winding seat 404. In this method, the coil winding 410 is wound so that in cross-section the winding displays alternating columns of three and four circles, each circle of a column being displaced in the direction between the flanges 402 from a respective circle in a neighbouring column by a distance equal to the radius of the coil winding 410.

In the above-described conventional ignition coils for an internal combustion engine, the coil winding 410 is circular in cross-section. Thus, even though the coil winding 410 is packed tightly between both flange portions 402, gaps are formed between the adjacent rounds of the coil winding 410. Consequently, the size of the ignition coil for an internal combustion engine is increased according to the size of the gaps.

Also, each gap is filled with air. The heat conductivity of air is lower than that of the coil winding 410 of enamel wire. Thus, heat generated at the primary coil during the use of the ignition coil is not radiated efficiently and promptly.

SUMMARY OF THE INVENTION

It is therefore a first object of the present invention to provide an ignition coil which can have a small height, can be small enough to avoid or minimize interference with adjacent ignition coils in an engine, and can provide a sufficiently large secondary energy.

A second object of the present invention is to provide an ignition coil for an internal combustion engine which is compact and superior in heat-radiating performance.

In order to at least partially address the first object, in a first aspect the present invention provides an ignition coil for an internal combustion engine which includes a coil member, the coil member including a substantially disk-shaped primary coil section having a primary coil winding wound thereon and a substantially disk-shaped secondary coil section having a secondary coil winding wound thereon. The primary coil section and the secondary coil section face each other, and a core region of each coil section is aligned with a core region of the other coil section. The coil member has a thickness parallel to the thickness direction of the primary and secondary coil sections of 10–25 mm (that is, it is "flat").

At least one pair of radial core sections each formed of a plurality of core portions having an overlapping portion at a center thereof are combined with each other in a radial formation and installed on upper and lower sides of the coil member, such that the coil member is sandwiched between the at least one pair of radial core sections to form a plurality of magnetic paths passing from a center of the coil member to a periphery thereof. In this case, preferably, a concave portion is formed on the overlapping portion of at least one of the core portions to receive an overlapping portion of another of the core portions.

Preferably, the coil member having the radial core sections installed thereon is accommodated inside a case member and fixed thereto by insulation resin charged into the case member by injection.

The primary coil section and the secondary coil section face each other, exposing a surface of the primary coil section opposite to a surface thereof facing the secondary coil section. In this case, insulation resin may be injected into the case member, with an insulation spacer interposed between the exposed surface of the primary coil section and at least one core portion of the radial core section which faces the exposed surface.

Preferably the case member is vibrated when insulation resin is injected into the case member accommodating a coil member having radial core sections installed thereon.

To at least partially address the second object, the invention provides, in a second aspect, an ignition coil for an internal combustion engine which includes a coil winding seat having a pair of flange portions between which a coil winding is wound. In this construction, the coil winding is linear and belt-shaped and has a width equal to an interval between the pair of flange portions and is wound on the coil winding seat such that the coil winding is wound upon itself.

Preferably, at least one of the pair of flange portions is so shaped that the coil winding wound on the coil winding seat is partially exposed.

These and other features and advantages of this invention are described in or are apparent from the following detailed description of the preferred embodiments.

BRIEF DESCRIPTION OF THE DRAWINGS

Preferred embodiments of this invention will be described in detail, with reference to the following figures, in which.

DETAILED DESCRIPTION OF PREFERRED EMBODIMENTS

Figure 1:
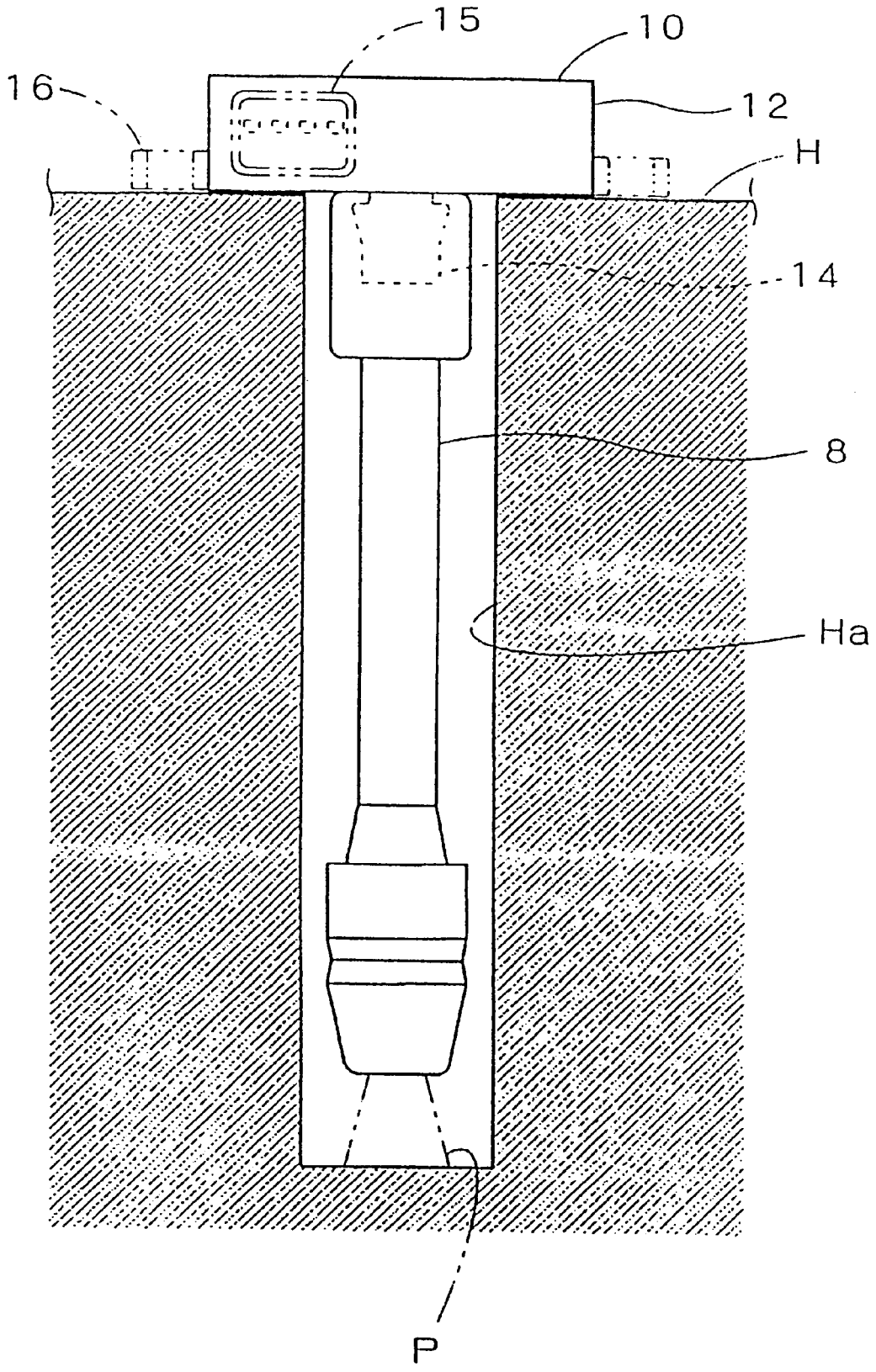
FIG. 1 is a view of a first embodiment of an ignition coil according to the present invention in use within an internal combustion engine.
Figure 2:
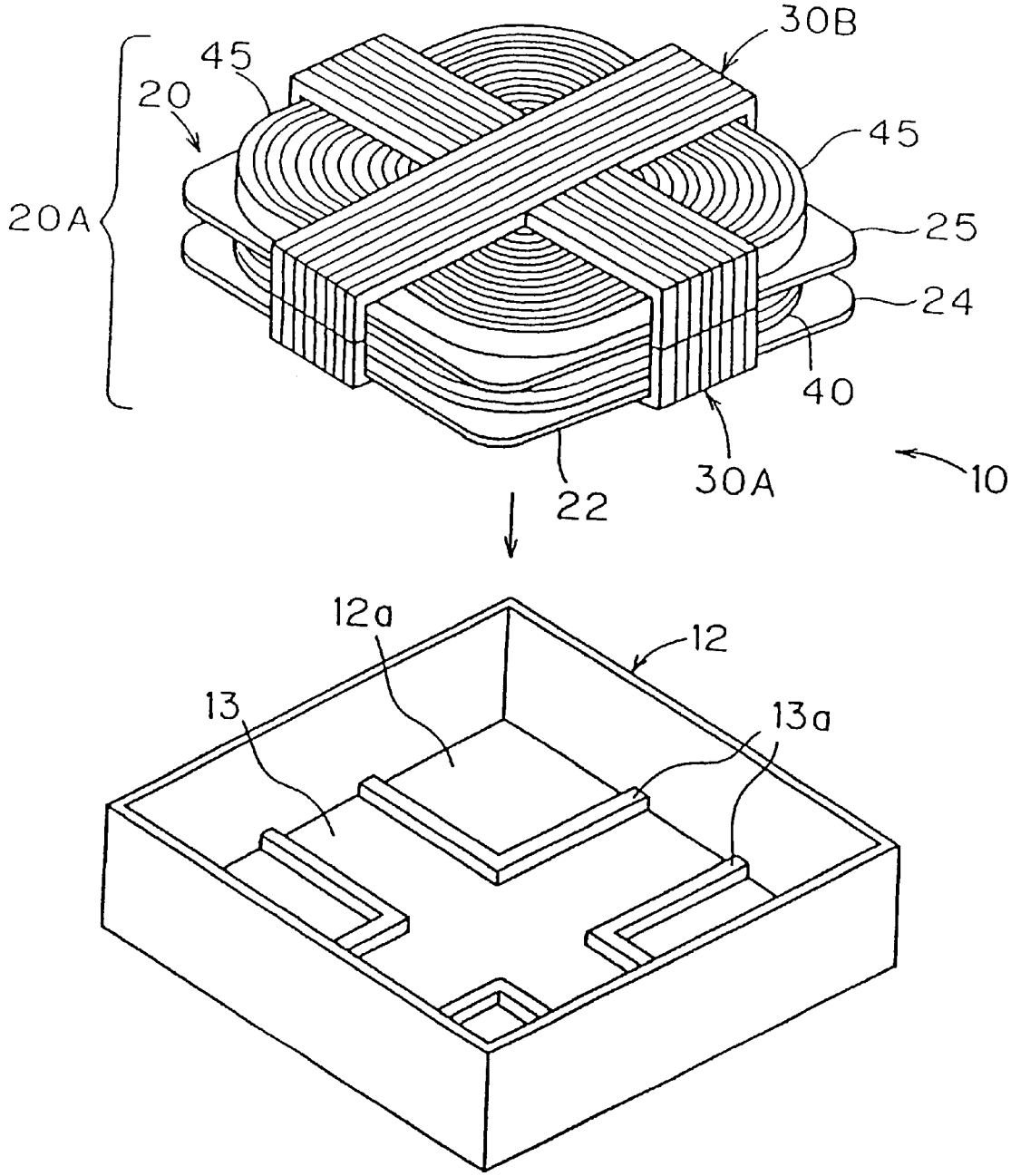
FIG. 2 is an exploded perspective view of the ignition coil shown in FIG. 1.

FIG. 1 shows a first embodiment of an ignition coil 10 for an internal combustion engine. The ignition coil 10 is of the so-called "upward-set" type which is installed on the upper end of an opening of a plug hole Ha formed in a cylinder head H of the internal combustion engine. As shown in FIG. 2, the ignition coil 10 includes a coil section 20A, which is provided with a core and accommodated in a case 12 made, for example, of synthetic resin.

Figure 3:
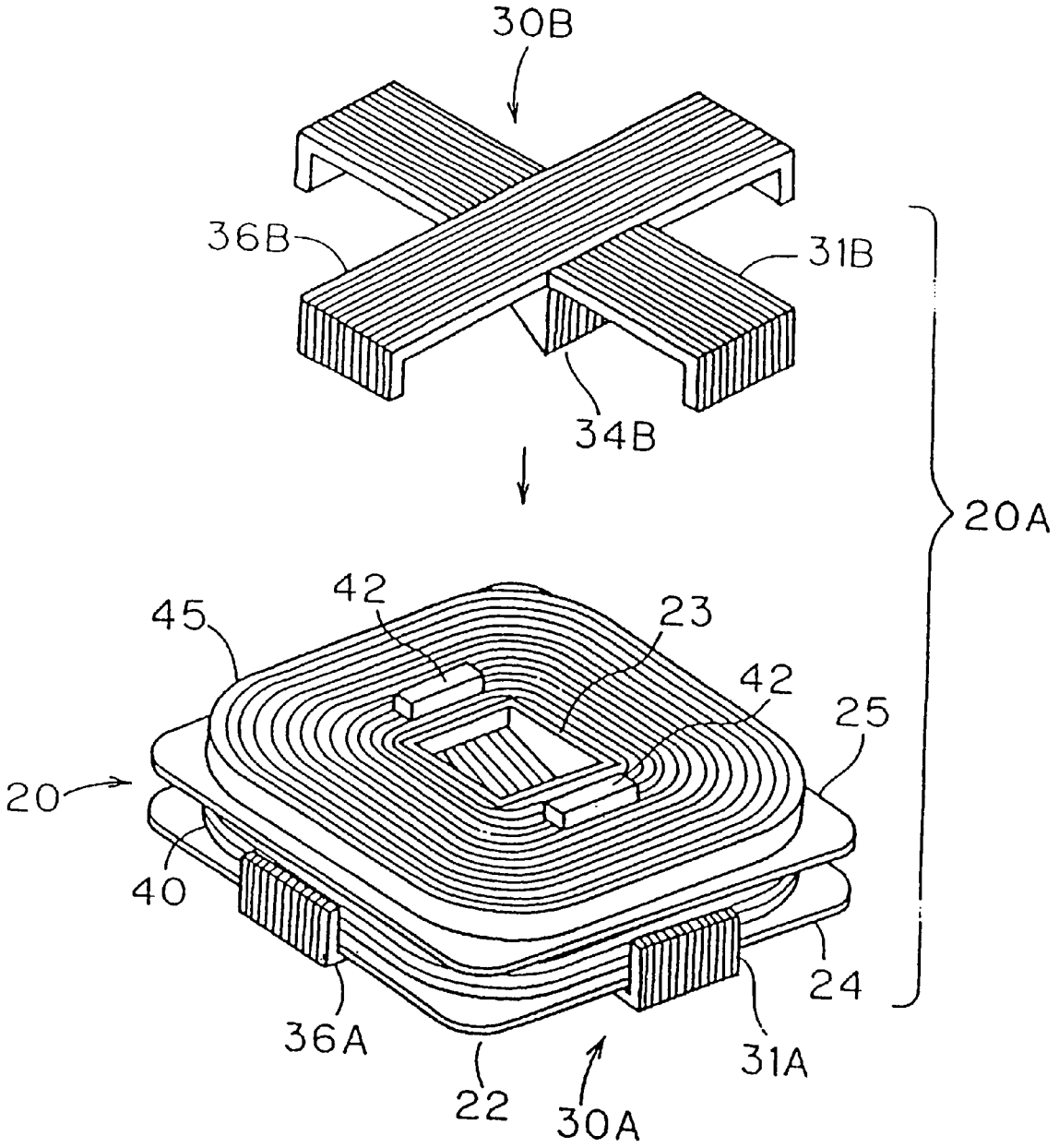
FIG. 3 is an exploded perspective view of the coil section of the embodiment of FIG. 1 provided with a core.
Figure 4:
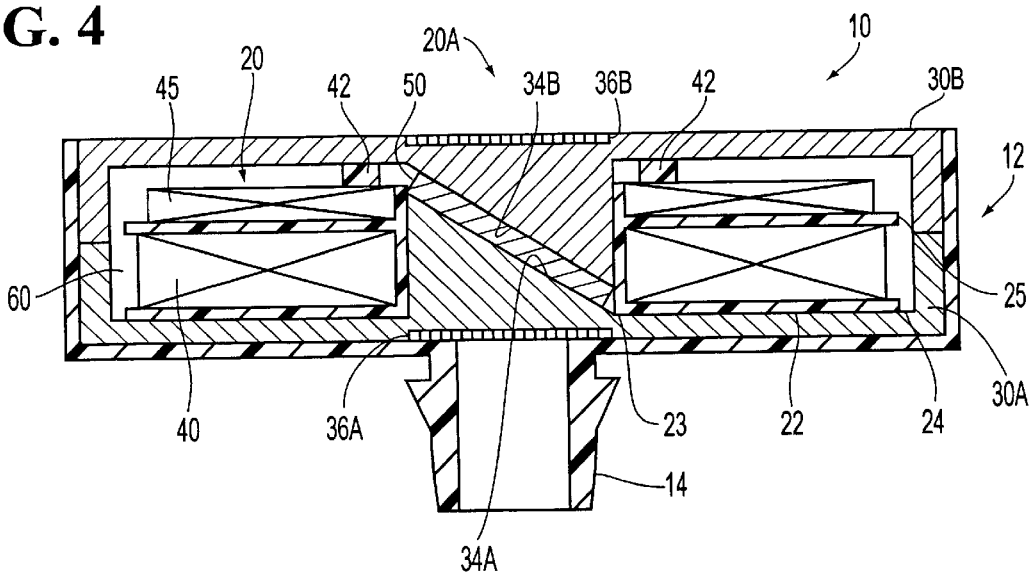
FIG. 4 is a sectional view of the ignition coil of FIG. 1.

As shown in FIGS. 2 to 4, the coil section 20A includes a flat coil 20 with an approximately disk-shaped primary coil section 45 and an approximately disk-shaped secondary coil section 40. Cross-shaped core sections 30A and 30B (radial core sections) are installed on the lower and upper surfaces, respectively, of the coil 20.

Figure 9:
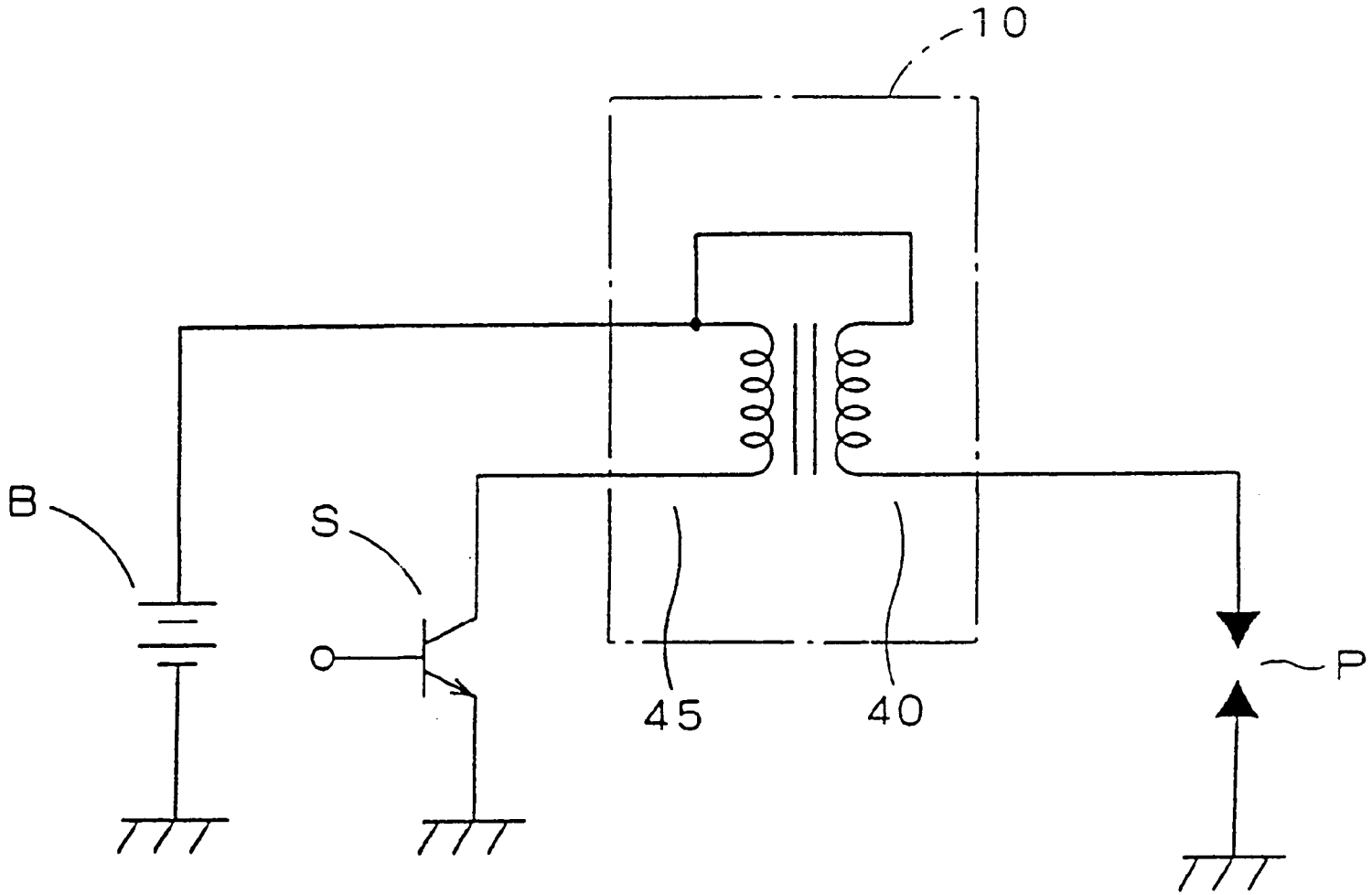
FIG. 9 is a wire connection view of the ignition coil of the embodiment.

FIG. 9 shows an example of possible electrical connections of the ignition coil 10. As shown in FIG. 9, one end of an enamel wire wound on the primary coil section 45 of the ignition coil 10 extends to the outside of the case 12 and is electrically connected to a positive terminal of a battery B of a vehicle. A negative terminal of the battery B is grounded. The other end of the enamel wire wound on the primary coil section 45 is grounded through a switching element S, such as a power transistor, provided within or outside the case 12. The switching element S is turned on and off upon receipt of ignition signals transmitted from an ECU or the like (not shown), which is provided on the vehicle body and adapted to apply a primary voltage intermittently to the primary coil section 45 from the battery B.

One end of the enamel wire wound on the secondary coil section 40 is electrically connected to one end of the enamel wire wound on the primary coil section 45 inside the case 12. The other end of the enamel wire wound on the secondary coil section 40 is electrically connected to an ignition plug P via a joint member 8 accommodated inside the plug hole Ha (see FIG. 1). Upon the intermittent application of a primary voltage to the primary coil section 45, a high voltage is generated at the secondary coil section 40 by electromagnetic induction. The generated high voltage is applied to the ignition plug P. As a result, the ignition plug P generates a spark.

Returning to FIGS. 1 through 4, the construction of each part of the ignition coil 10 will be described below. As shown in FIGS. 1, 2, and 4, the case 12 is flat, square and box-shaped, and the upper surface of the case is open. A connection section 14 extends vertically from the center of the lower surface of the case 12. A connection terminal (not shown) is provided inside the connection section 14 by insert molding and is electrically connected to the ignition plug P inside the plug hole Ha via the joint member 8. Four approximately L-shaped projections 13*a* are formed on an interior bottom surface 12*a* of the case 12, with the four corners of the respective projections 13*a* spaced from each other at predetermined intervals and facing one another to form a cross-shaped positioning groove 13 into which a cross-shaped section 30A, which will be described later, is fitted.

As shown by a two-dot chain line of FIG. 1, a fixing portion 16 for installing the ignition coil 10 on the cylinder head H is provided on both side surfaces of the case 12. A connector 15 for electrically connecting the ignition coil 10 and the ECU with each other is provided on a front surface of the case 12.

As shown in FIGS. 2 through 4, the coil 20 includes a bobbin 22 and the primary and secondary coil sections 45 and 40 are both installed or wound on the bobbin 22.

The bobbin 22 includes a bobbin body 23 which is short and in the shape of a hollow rectangular pillar. A pair of flange portions 24 and 25 extending radially are formed respectively at the lower end of the bobbin body 23 and at an intermediate position of the bobbin body 23 in the axial direction thereof. The flange portions 24 and 25 are approximately rectangular in correspondence to the internal shape of the case 12.

Figure 5:
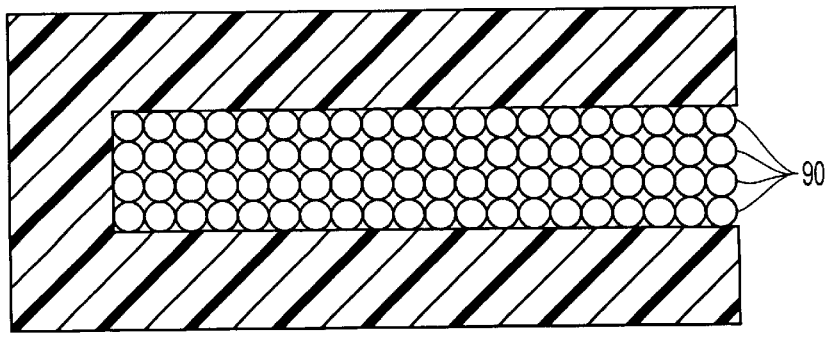
FIG. 5 is a sectional view of one example of a secondary coil section of an ignition coil according to the present invention.

The secondary coil section 40 includes an enamel wire (secondary coil winding) used as the secondary coil winding and wound in the shape of a disk between the flange portions 24 and 25 (see FIG. 5 for a possible winding arrangement). Both ends of the enamel wire extend outside the space between the flange portions 24 and 25. The enamel wire that is used for the secondary coil section 40 may be of a known variety. That is, the enamel wire may be, for example, a copper wire substantially circular in cross-section, with enamel paint applied to the surface of the copper wire.

More specifically, it is preferable to wind an enamel wire having a diameter in the range of 0.04–0.1 mm 8000–15000 times between the flange portions 24 and 25 to form the secondary coil section 40.

The upper end of the bobbin body 23 projects upward from the upper flange portion 25. The primary coil section 45 is installed on a top surface of the upper flange 25.

The primary coil section 45 includes a long rectangular belt-shaped enamel wire formed by applying enamel paint to the surface of a copper wire which is belt-shaped with a rectangular cross-section. The enamel wire is wound around itself in the thickness direction of the wire to obtain a disk-shaped primary coil winding (see FIG. 6 for the winding arrangement). An approximately square hole through which the upper end of the bobbin body 23 can be inserted is formed at the center of the primary coil section 45.

Heat-welding paint or fusing paint may be applied to the surface of enamel wire for use in forming the primary coil section 45 to impart the enamel wire with a self-fusing property. Thus, by winding the enamel wire while it is being heated or by heating it after it is wound, the coiled enamel wire is hardened in the shape of a disk.

More specifically, it is preferable to form the primary coil section 45 by winding belt-shaped enamel wire having a rectangular cross section of aspect ratio 1:15–1:35, 90–180 times radially.

The reason for using the rectangular belt-shaped enamel wire as the primary coil section 45 is described below.

For example, referring to FIG. 5 (which shows one side of the cross-section of a wound coil), when an enamel wire 90 substantially circular in cross-section is used, spaces are formed between adjacent layers of the enamel wire 90 however closely the enamel wire 90 is wound upon itself. Consequently, if made from wire that is circular in cross-section, the primary coil section is large, which causes heat generated therein to be radiated inefficiently.

On the other hand, in the embodiment, an enamel wire 92, which has a rectangular cross-section and is belt-shaped, is wound in its thickness direction for the primary coil section 45. In this case, referring to FIG. 6 (which shows one side of the cross-section of the primary coil section 45), it is possible to wind the enamel wire 92 with no gap between its layers. Thus, it is possible to allow the primary coil section 45 to be compact and hence the ignition coil to be thin and small in its radial direction, and thus transmit heat generated therein effectively, i.e., allow the primary coil section 45 to radiate heat efficiently.

The upper end of the bobbin body 23 is inserted into the hole formed at the center of the primary coil section 45 to mount the primary coil section 45, thus producing the construction on the upper surface of the flange portion 25 shown in FIGS. 2 through 4. As a result, the primary coil section 45 and the secondary coil section 40 are vertically layered one above the other, with the cores thereof coincident with the axis of the bobbin body 23, to form the coil 20.

In this description, calling the coil 20 "flat" means that it has a height in the range of 10–25 mm. Preferably, the ratio between the height and the width (in this embodiment, the minimum width, i.e. the length of one of the four sides of the flange portions 24 and 25) is 1:2–1:6. More preferably, the ratio therebetween is 1:3–1:5. As described above, the upper limit of the height of the coil 20 is usually set to 25 mm. This is because if the coil has a height more than 25 mm and is accommodated in the case 12, the case 12 interferes with suction and exhaust component parts positioned in the vicinity of the cylinder head H. As described above, the lower limit of the height of the coil 20 is usually set to 10 mm. This is because it is necessary to provide space for installing a connector 15, a fixing portion 16, switching elements, and the like inside the case 12 accommodating the coil 20.

Both ends of the enamel wire wound on the primary coil section 45 and both ends of the enamel wire wound on the secondary coil section 40 extend to the outside of the coil 20. One end of the enamel wire of the primary coil section 45 and one end of the enamel wire of the secondary coil section 40 are electrically connected with each other (not shown) at a position on the periphery of the flange portion 25 to form the coil 20.

As shown in FIGS. 2 through 4, the cross-shaped core sections 30A and 30B are installed on the lower and upper surfaces, respectively, of the coil 20.

As shown in FIGS. 2, 3, 4, 7, and 8, the cross-shaped core section 30B is formed from an approximately E-shaped core portion 31B and an approximately U-shaped core portion 36B made of electromagnetic steel plates stacked one upon another. The core portions 31B and 36B intersect with each other at their center portions to combine crosswise.

When the core portion 31B including a lateral piece 32B and the core portion 36B including a lateral piece 37B are combined with each other, the core portion 36B is located on top of the core portion 31B. A vertical piece 38B projects downward from each end of the lateral piece 37B.

The core portion 36B has a concave portion 39B into which the overlapping portion of the core portion 31B is fitted. The concave portion 39B is formed at the overlapping portion of the core portion 36B where the lower surface of the lateral piece 37B of the core portion 36B overlaps the upper surface of the lateral piece 32B of the core portion 31B. The depth of the concave portion 39B is about half of the thickness of the lateral piece 37B.

When the core portion 31B including the lateral piece 32B and the core portion 36B including the lateral piece 37B are combined with each other, the core portion 31B is located under the core portion 36B. A vertical piece 33B projects downward from each end of the lateral piece 32B.

The core portion 31B has a concave portion 35B into which the overlapping portion of the core portion 36B is fitted. The concave portion 35B is formed at the overlapping portion of the core portion 31B where the lower surface of the lateral piece 37B of the core portion 36B overlaps the upper surface of the lateral piece 32B of the core portion 31B. The depth of the concave portion 35B is about half of the thickness of the lateral piece 37B.

A trigonal prism-shaped center portion 34B having a tapered surface projects downward, orthogonal to the lengthwise direction of the core portion 31B, from the middle of the lower surface of the lateral piece 32B of the core portion 31B. The center portion 34B can be inserted downward into the bobbin body 23, with the cross core section 30B installed on the upper surface of the coil 20 (see FIGS. 3 and 4).

In order to form the cross-shaped core section 30B, the concave portions 35B and 39B positioned in the middle of each of the lateral pieces 32B and 37B are inserted into each other to intersect the core portions 31B and 36B. As a result, the core portions 31B and 36B are combined with each other crosswise. In this manner, the upper surface of the lateral piece 37B and that of the lateral piece 32B are flush with each other.

The shape of the cross-shaped core section 30A to be positioned below the cross core section 30B is similar to that of the cross core-shaped section 30B turned upside down. That is, the middle portion of an E-shaped core portion 31A having upward vertical pieces 33A projecting from both ends thereof intersects with the middle portion of a U-shaped core portion 36A having upward vertical pieces 38A projecting from both ends thereof. In this manner, the core portions 31A and 36A are combined with each other crosswise to form the cross-shaped core section 30A. The core portion 31A has a concave portion 35A into which the overlapping portion of the core portion 36A is fitted. The concave portion 35A is formed at the overlapping portion of a lateral piece 32A where the lower surface of the lateral piece 32A of the core portion 31A overlaps the upper surface of a lateral piece 37A of the core portion 36A. Similarly, the core portion 36A has a concave portion 39A into which the overlapping portion of the core portion 31A is fitted. The concave portion 39A is formed at the overlapping portion of the lateral piece 37A where the lower surface of the lateral piece 32A of the core portion 31A overlaps the upper surface of the lateral piece 37A of the core portion 36A. In order to form the cross-shaped core section 30A, the concave portions 35A and 39A are inserted into each other to intersect the core portions 31A and 36A in the middle portion thereof. As a result, the core portions 31A and 36A are combined with each other crosswise. A trigonal prism-shaped center portion 34A having a tapered surface projects upward, orthogonal to the lengthwise direction of the core portion 31 A from the middle of the upper surface of the lateral piece 32A thereof, thus forming the center leg of the "E" shape of the E-shaped core portions 31A and 31B, respectively.

In installing the cross core sections 30A and 30B on the lower and upper surfaces, respectively, of the coil 20, the center portions 34A and 34B are inserted into the bobbin body 23 facing upward and downward, respectively. At this time, upward end surfaces of the two vertical pieces 33A of the core portion 31A and downward end surfaces of the two vertical pieces 33B of the core portion 31B are brought into contact with each other on the periphery of the coil 20. Similarly, upward end surfaces of the two vertical pieces 38A of the core portion 36A and downward end surfaces of the two vertical pieces 38B of the core portion 36B are brought into contact with each other on the periphery of the coil 20 (see FIGS. 2 through 4).

The tapered surface of the center portion 34A and the tapered surface of the center portion 34B are parallel with each other and spaced at a predetermined distance inside the bobbin body 23. A permanent magnet 50 for magnetically applying a reverse bias to the cross core sections 30A and 30B is provided between the center portions 34A and 34B (see FIG. 4).

This construction provides four closed magnetic paths passing from the center of the coil 20 to the four sides of the periphery thereof.

It is preferable that the core portions 31A and 36A of the cross core section 30A and the core portions 31B and 36B of the cross core section 30B each include an approximately U-shaped or E-shaped plate formed of a plurality of laminated chrome oxide coated silicon steel (electromagnetic steel) plates each having a thickness of 0.1–0.5 mm. It is preferable that the sectional area of the internal magnetic path consisting of the center portions 34A and 34B is 100–324 $mm^2$ and that the total of the sectional area of external magnetic paths formed of the lateral pieces 32A, 37A, 32B, and 37B, and the vertical pieces 33A, 38A, 33B, and 38B is 100–324 $mm^2$.

As shown in FIGS. 3 and 4, a pair of insulation spacers 42 may be interposed between the upper surface of the primary coil section 45 exposed on the upper side of the coil 20 and the core portion 31B of the cross core section 30B positioned on the upper side of the coil 20.

The insulation spacers 42 are each made of an insulating material and provided at positions opposite with respect to the bobbin body 23. The insulation spacers 42 allow the cross core section 30B to be installed on the primary coil section 45 with a sufficient insulation distance kept between the cross core section 30B and the primary coil section 45.

The insulation spacers 42 are provided between the coil 20 and the core portion 31B underlying the core portion 3 6B when the core portion 31B and the core portion 36B are combined with each other. This is because if the insulation spacers 42 were provided between the core portion 36B and the coil 20, the insulation spacers 42 could not prevent the core portion 31B underlying the core portion 36B from moving downward. If desired, insulation spacer(s) may be provided between the coil 20 and both the core portion 31B and the core portion 36B.

The method of assembling the ignition coil will be described below. First, by soldering or the like, one end of the enamel wire of the secondary coil section 40 is connected (not shown) with a connection terminal that is insert-moulded on the connection section 14 of the case 12. Then, as shown in FIGS. 2 and 4, the cross-shaped core section 30A to be underlying the cross-shaped core section 30B is accommodated in the positioning groove 13 formed inside the case 12. Next, the coil section 20A is accommodated inside the case 12. The cross-shaped core section 30B is then placed inside the case, over top of the coil section 20A.

In this state, the case 12 is filled with liquid insulation resin 60, such as epoxy resin, by injection. Then, the insulation resin 60 is heat-treated to harden it. As a result, the coil section 20A is fixed to the case 12. As described previously, the insulation spacer 42 may be interposed between the exposed upper surface of the primary coil section 45 and the cross-shaped core section 30B. Thus, when the insulation resin 60 is injected into the space between the primary coil section 45 and the cross-shaped core section 30B, a sufficient insulation distance is secured therebetween. Further, because the insulation resin 60 is injected into the space between the primary coil section 45 and the cross-shaped core section 30B, the insulation resin 60 penetrates sufficiently into any space between layers of the enamel wire of the primary coil section 45.

In the ignition coil for an internal combustion engine, the approximately disk-shaped primary coil section 45 and the approximately disk-shaped secondary coil section 40 are vertically layered one above the other, with the cores thereof coincident with each other to form the flat coil 20. Therefore, the ignition coil has a small height, is prevented from interfering with adjacent ignition coils, and, further, provides a sufficiently great secondary energy.

Figure 6:
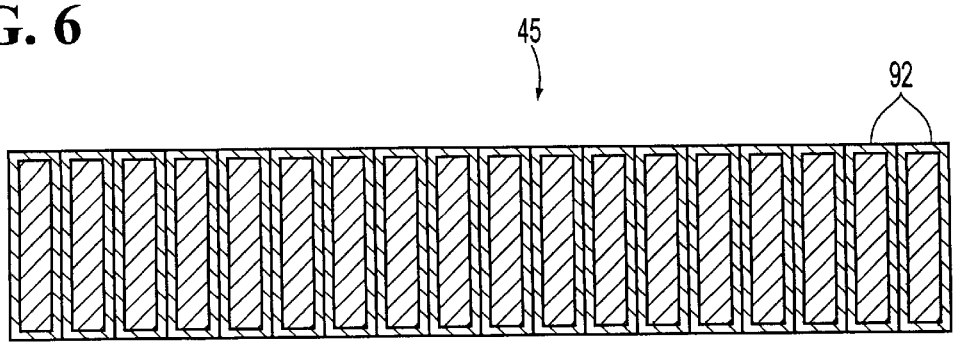
FIG. 6 is an enlarged sectional view showing a primary coil section of an ignition coil according to the present invention.
Figure 7:
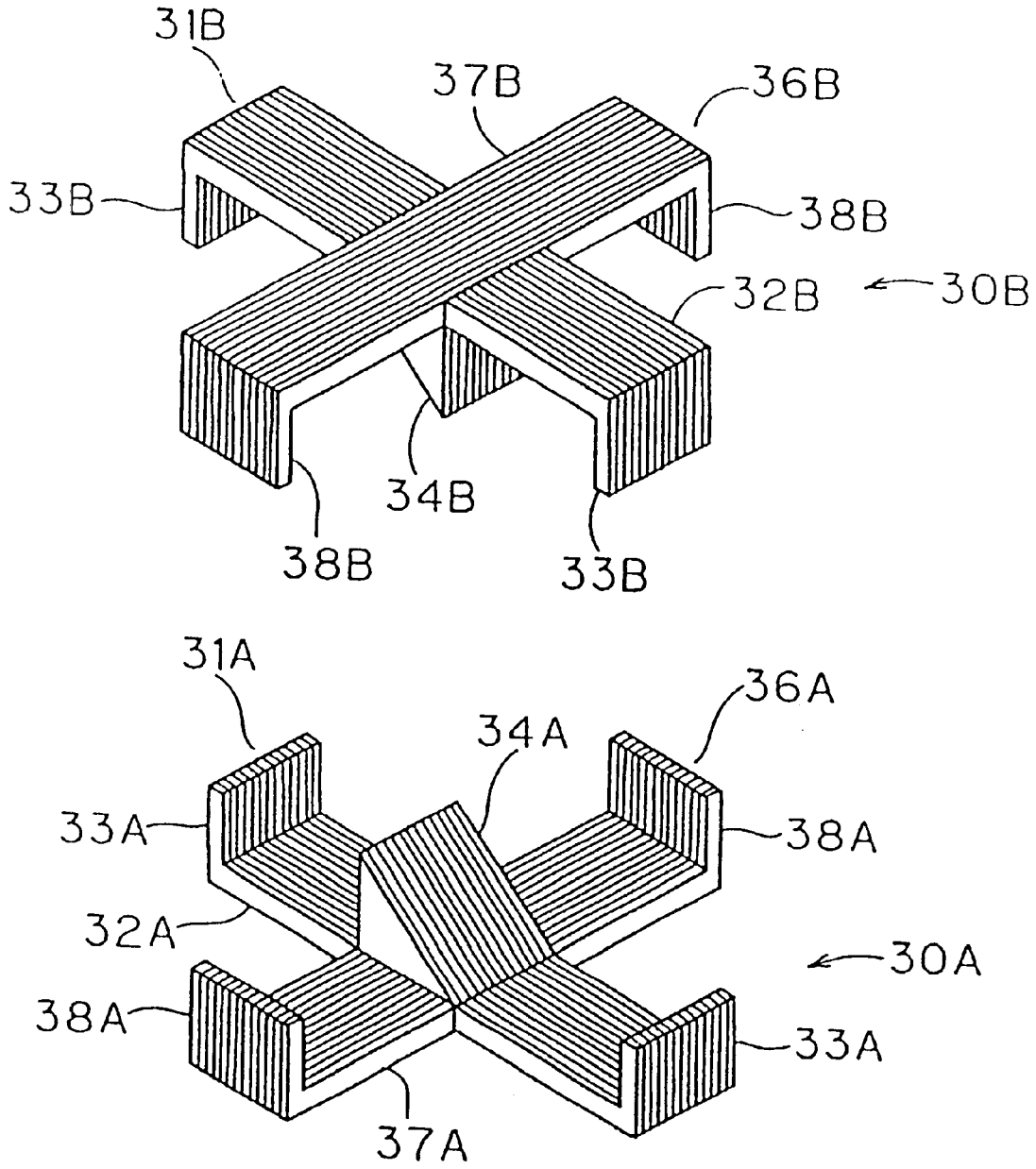
FIG. 7 is a perspective view of two cross-shaped core sections which are part of the first embodiment.
Figure 8:
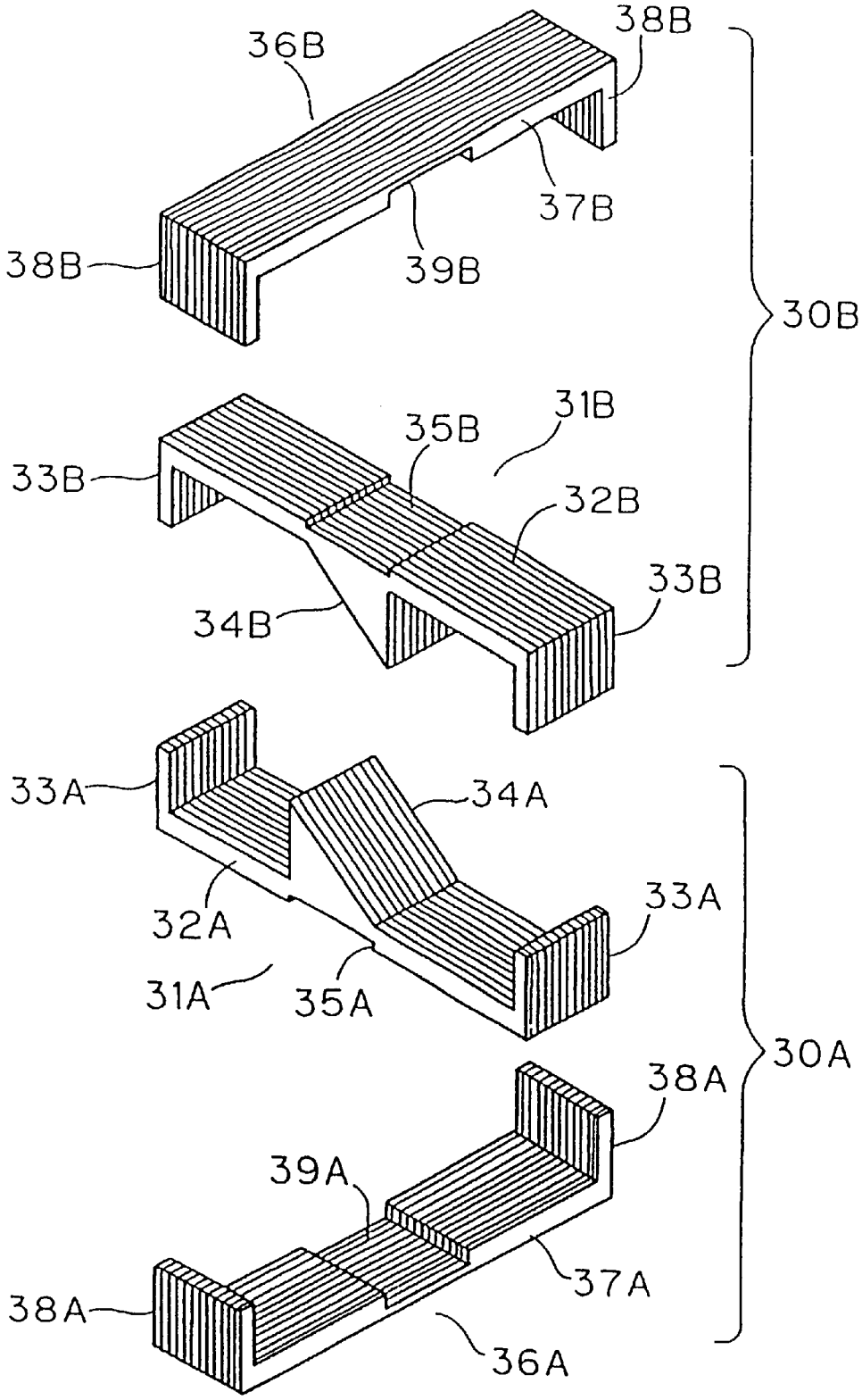
FIG. 8 is an exploded perspective view of the cross-shaped core sections of FIG. 7.

In particular, as shown in FIGS. 3 and 6, the rectangular belt-shaped enamel wire 92 is wound in layers in the thickness direction thereof to form the primary coil section 45. Thus, the primary coil section 45 is allowed to be thin and compact and hence the ignition coil is allowed to be thin and compact, and, further, has improved heat-radiating performance.

Further, because the four closed magnetic paths passing from the center of the coil 20 to the peripheral four sides thereof are formed of the cross core sections 30A and 30B, the total sectional area of the four closed magnetic paths is large. Thus, it is possible for the ignition coil to provide a sufficiently great secondary energy.

Each of the concave portions 35A and 39A is formed at an overlapping portion of the core portions 31A and 36A. Further, each of the concave portions 35B and 39B is formed at an overlapping portion of the core portions 31B and 36B. Thus, it is possible to reduce the thickness of each of the overlapping portion of the core portions 31A and 36A and the overlapping portion of the core portions 31B and 36B. Therefore, it is possible to reduce the height of the ignition coil.

There is described below a comparison of the ignition coil described above with an ignition coil shown in FIGS. 12 and 13 and with an ignition coil shown in FIGS. 14 and 15. Neither of these latter ignition coils has previously been made public.

Figure 12:
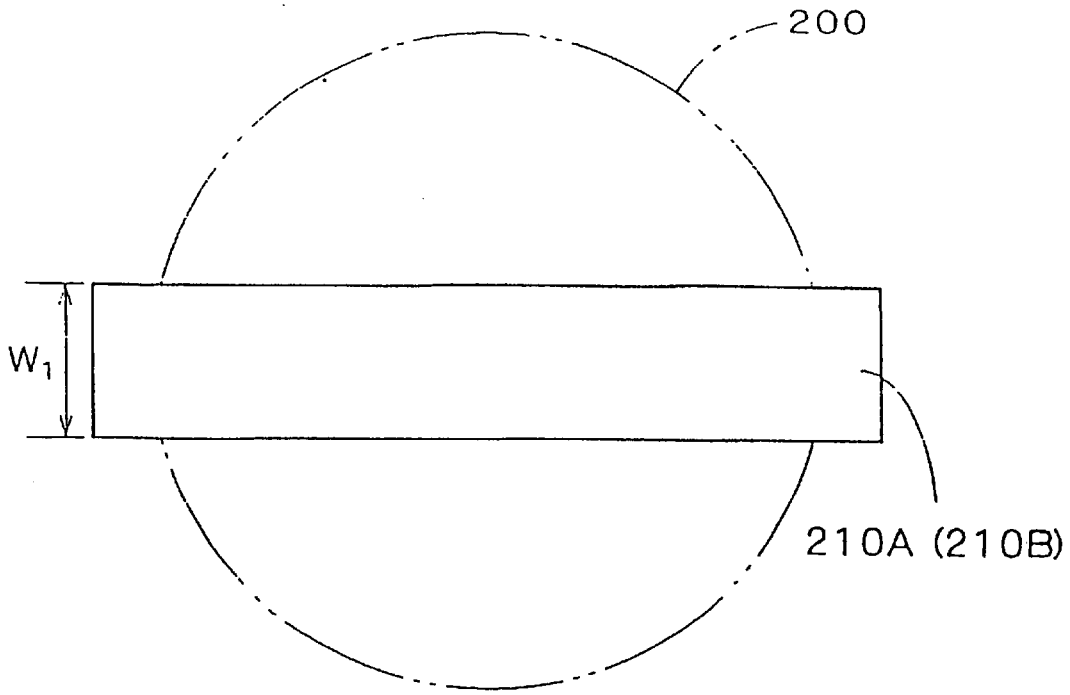
FIG. 12 is a plan view of a core portion of a comparative example.
Figure 13:
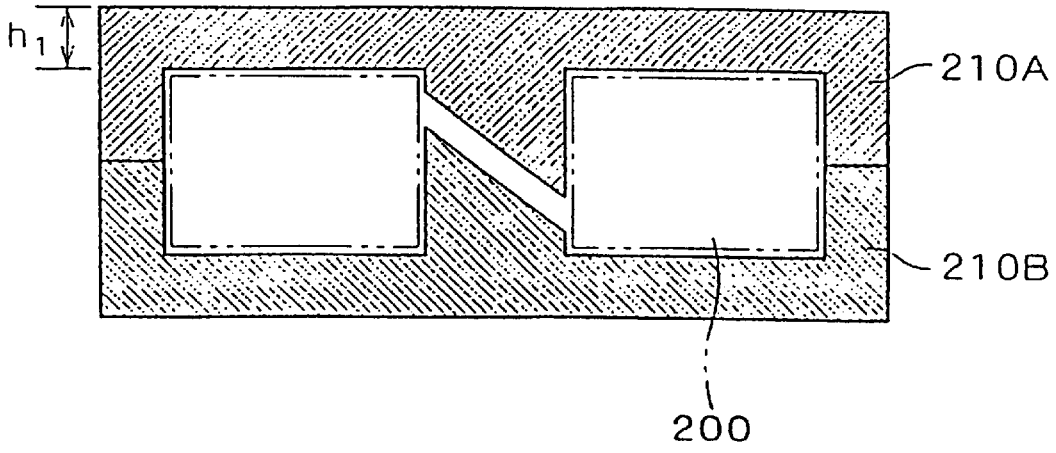
FIG. 13 is a sectional view of the core portion of the comparative example shown in FIG. 12.

In the ignition coil shown in FIGS. 12 and 13, each of approximately E-shaped core portions 210A and 210B is installed on each of upper and lower sides of a coil 200 to form two closed magnetic paths passing from the center of the coil 200 to the periphery thereof.

In this case, to increase the total of the sectional areas of external magnetic paths formed on the periphery of the coil 200, it is necessary to make the core portions 210A and 210B thick. Consequently, the entire ignition coil becomes large.

For example, supposing that the total of the sectional areas of the external magnetic paths is demanded to be 400 $mm^2$ to obtain a secondary energy of a predetermined magnitude, the width W1 of each of the core portions 210A and 210B is set to 20 mm and the thickness hi thereof is set to 10 mm. In this case, $20(mm)\times10\ (mm)\times2=400\ (mm^2)$, which satisfies the demand. In this case, the height of the ignition coil is increased by the total (=20 mm) of the thickness of the core portions 210A and 210B.

Figure 14:
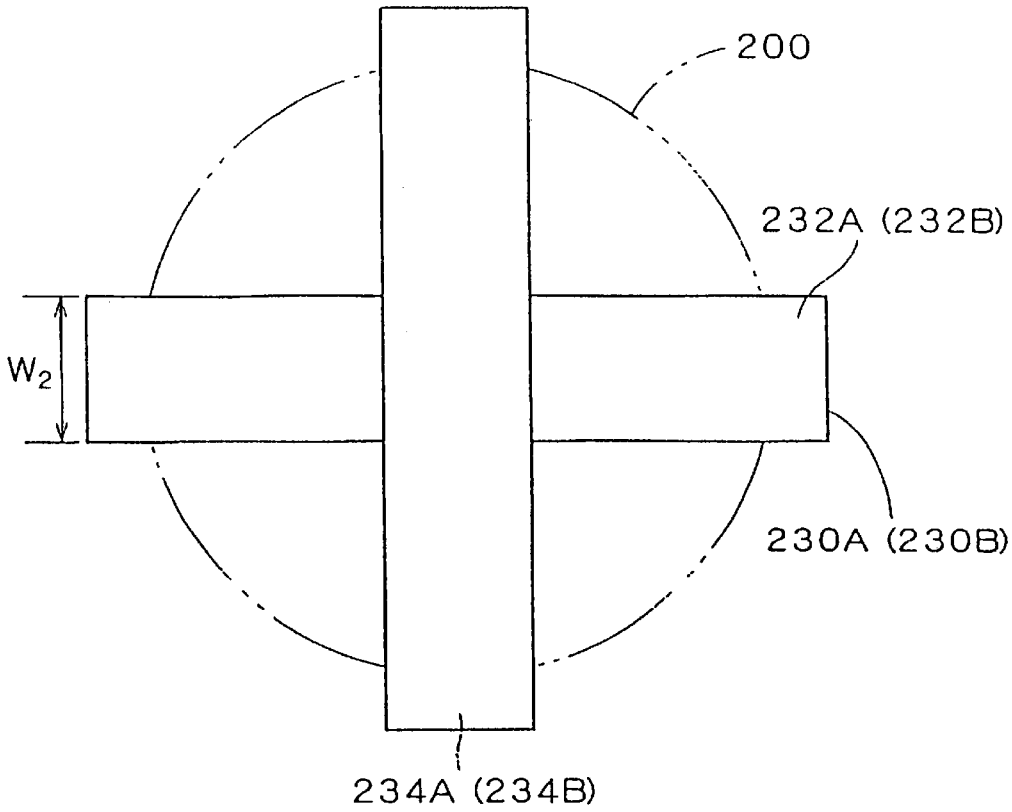
FIG. 14 is a plan view of a core portion of another comparative example.
Figure 15:
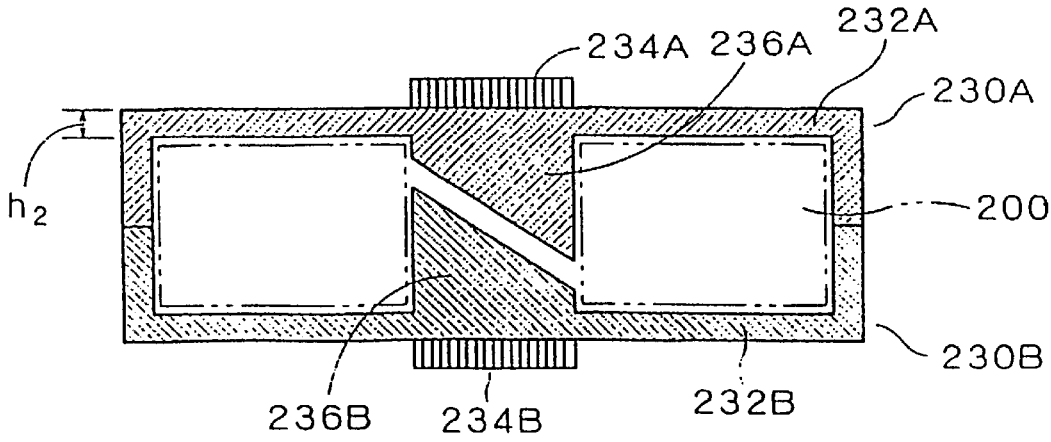
FIG. 15 is a sectional view of the core portion of the comparative example shown in FIG. 14.

In the ignition coil shown in FIGS. 14 and 15, to form cross-shaped core sections 230A and 230B, an approximately E-shaped core portion 232A and an approximately U-shaped core portion 234A, and an approximately E-shaped core portion 232B and an approximately U-shaped core portion 234B, intersect cross-shaped core sections 230A and 230B are installed on the upper and lower surfaces of the coil 200, respectively to form four closed magnetic paths passing from the center of the coil 200 to the periphery thereof.

In this case, it is possible to make the thickness of each of the core portions 232A, 234A, 232B, and 234B smaller than that of each of the core portions 210A and 210B of the ignition coil shown in FIGS. 12 and 13. But the core portions 232A and 234A and the core portions 232B and 234B are merely overlapped with each other, respectively on the axis of the coil 200. Thus, the heights of the cross-shaped core sections 230A and 230B are large at the overlapping portion, which means that the ignition coil is large.

For example, when the width w2 of each of the iron cores 232A, 234A, 232B, and 234B is set to 20 mm, and the thickness h2 thereof is set to 5 mm, the total of the sectional areas of closed magnetic paths is 20(mm)×5 (mm)×4 (magnetic path)=400 ($mm^2$), which satisfies the above-described demand. But the iron cores 232A and 234A are merely overlapped with each other at the upper side of the axis of the coil 200, and similarly, the iron cores 232B and 234B are merely overlapped with each other at the lower side of the axis of the coil 200. Thus, at the overlapping portions, the height of the ignition coil is increased by the total (=20 mm) of the thickness of each of the iron cores 232A, 234A, 232B, and 234B.

Figure 10:
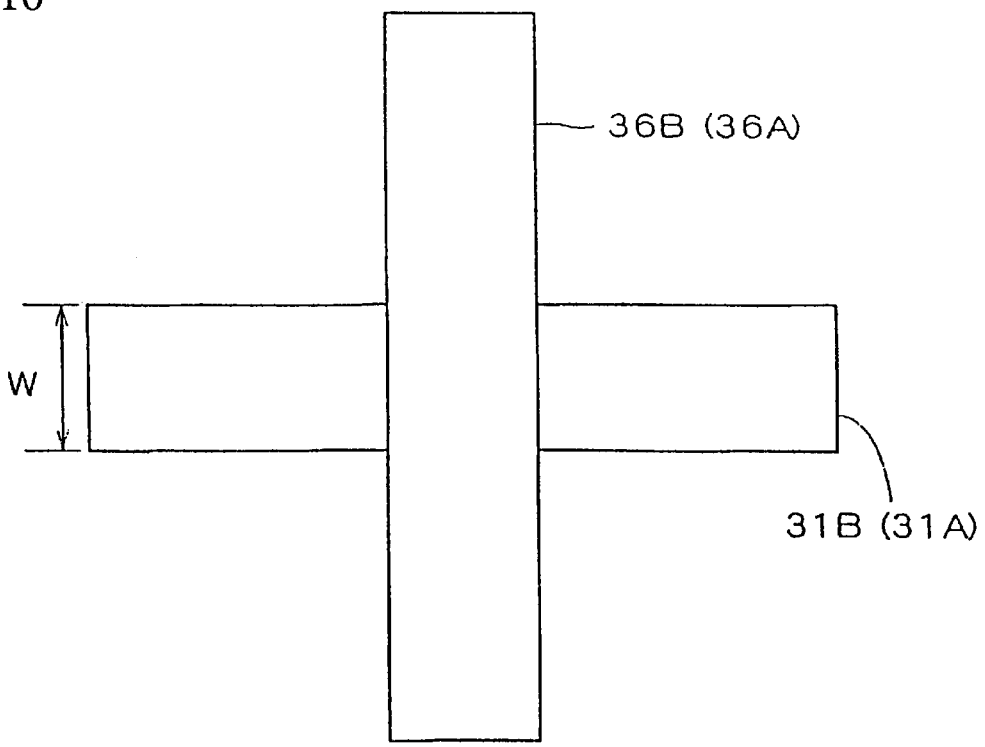
FIG. 10 is a plan view of a cross-shaped core section of FIG. 7.
Figure 11:
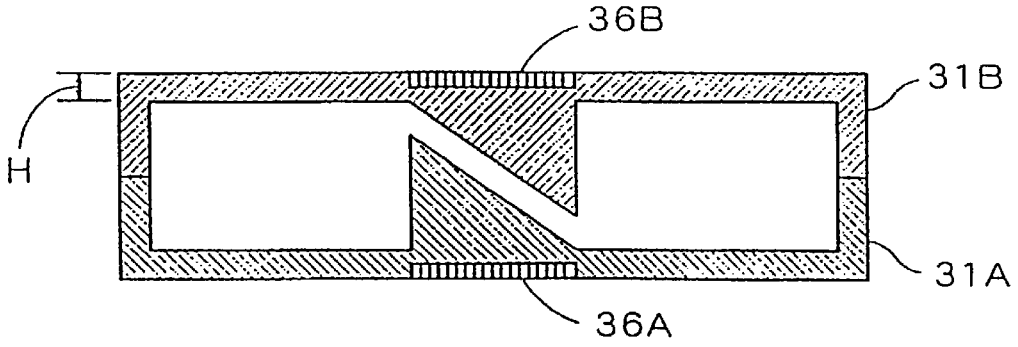
FIG. 11 is a sectional view of the two cross-shaped core sections of FIG. 7.

On the other hand, in the ignition coil of FIGS. 2 to 4, in order to obtain 400 $mm^2$ as the total of the sectional areas of the closed magnetic paths, when the width W of each of the core portions 31A, 36A, 31B, and 36B is set to 20 mm, and the thickness H of each thereof is set to 5 mm, as shown in FIGS. 10 and 11, the total of the sectional areas of closed magnetic paths is 20(mm)×5 (mm)×4 (magnetic path)=400 ($mm^2$), which satisfies the above-described demand.

In this case, the thickness of the overlapping portion of the core portions 31A and 36B and that of the core portions 31B and 36B are 5 mm, respectively. Thus, the total of the height of the core portions 31A, 36B, 31B, and 36B is 10 mm which is about half of the height of the iron core portions shown in FIGS. 12 and 13 and that of the iron core portions shown in FIGS. 14 and 15.

Further, as described above, the insulation spacers 42 are interposed in the space between the upper surface of the primary coil section 45 and the cross core section 30B. Thus, when the insulation resin 60 is injected into the space between the primary coil section 45 and the cross core section 30B, a sufficient insulation distance is secured therebetween. Thus, the space between the primary coil section 45 and the cross core section 30B is superior in electrical insulation performance. That is, in the ignition coil 10, the rectangular belt-shaped primary coil winding is layered in the thickness direction thereof. Then, the primary coil winding is hardened in the shape of a disk by heating it to form the primary coil section 45. Thus, it is unnecessary to form a flange portion on the upper side of the primary coil section 45, which further contributes to making the ignition coil 10 thin. In order to ensure electrical insulation performance between the primary coil section 45 and the cross core section 30B, the insulation spacers 42 are interposed in the space between the upper surface of the primary coil section 45 and the cross-shaped core section 30B.

Further, the insulation resin 60 penetrates sufficiently into any space between layers of the enamel wire of the primary coil section 45, to prevent the primary coil section 45 from getting out of shape and to allow the primary coil section 45 to be fixed in position reliably.

Furthermore, because the primary coil section 45 is pressed downward by the insulation spacers 42 when the coil 20 is assembled, the primary coil section 45 can be placed in position with higher accuracy than the conventional construction.

In injecting the insulation resin 60 into the case 12 after accommodating the coil section 20A inside the case 12, it is preferable to heat the case 12 and then inject the insulation resin 60 into the case 12 while the case 12 is being vibrated under vacuum. This method allows the insulation resin 60 to easily penetrate into gaps between adjacent enamel wires of the secondary coil section 40, and hence shortens the insulation resin-charging time period, thus facilitating the resin-charging operation.

Figure 16:
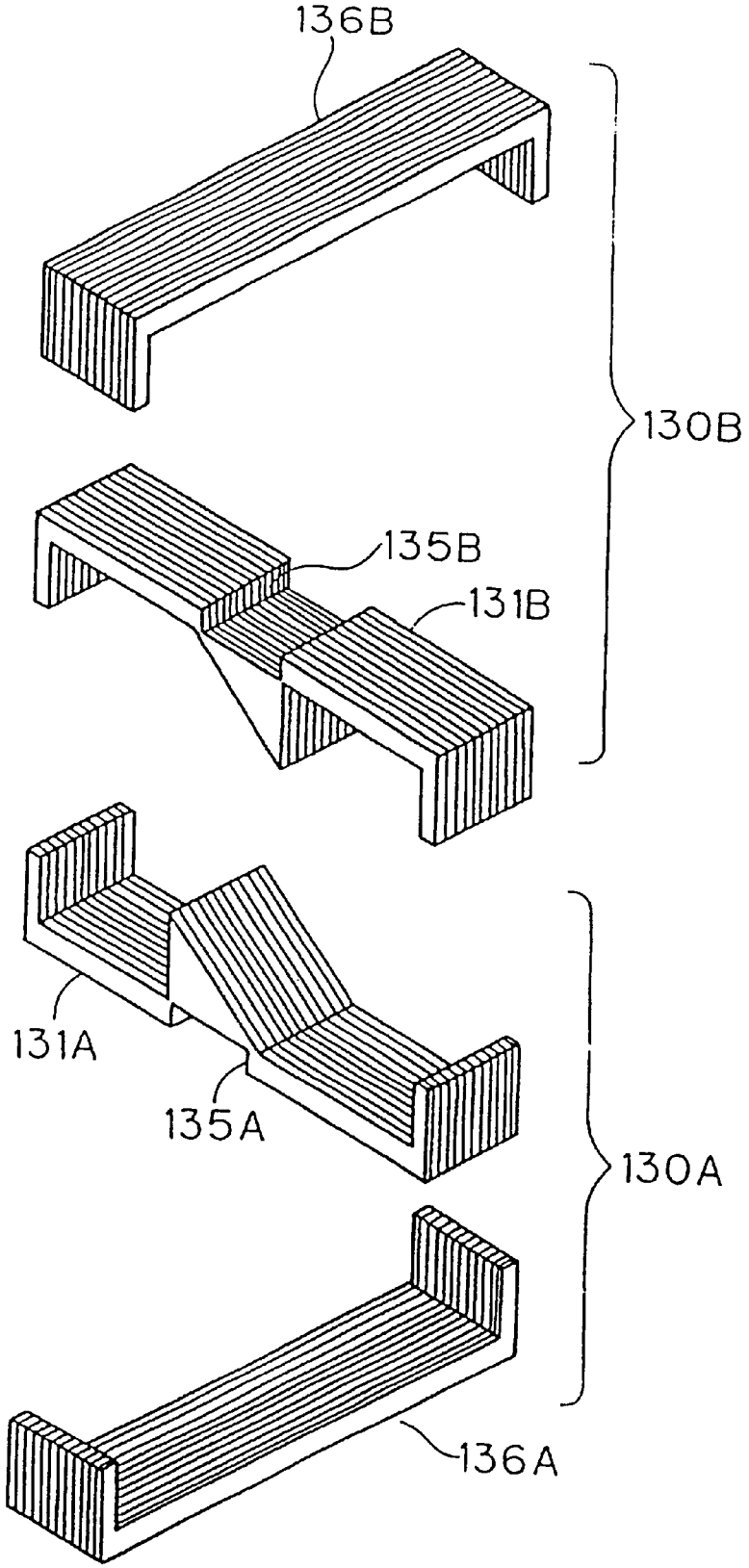
FIG. 16 is an exploded perspective view of cross-shaped core sections according to a first modification of the first embodiment.

In the embodiment described above, concave portions 35A and 39A are formed on the core portions 31A and 36A, respectively, forming the cross-shaped core section 30A, and concave portions 35B and 39B are formed on the core portions 31B and 36B, respectively, forming the cross-shaped core section 30B. It is possible to modify the above-described embodiment as shown in FIG. 16 (which shows a first modification of the embodiment). That is, in a cross-shaped core section 130B overlying a cross-shaped core section 130A, it is possible to form a concave portion 135B on the overlapping portion of only a lower core portion 131B to fit the overlapping portion of a mating core portion 136B into the concave portion 135B. Likewise, in the cross-shaped core section 130A underlying the cross-shaped core section 130B, it is possible to form a concave portion 135A on the overlapping portion of only a core portion 131 A to fit the overlapping portion of a mating core portion 136A into the concave portion 135A.

Figure 17:
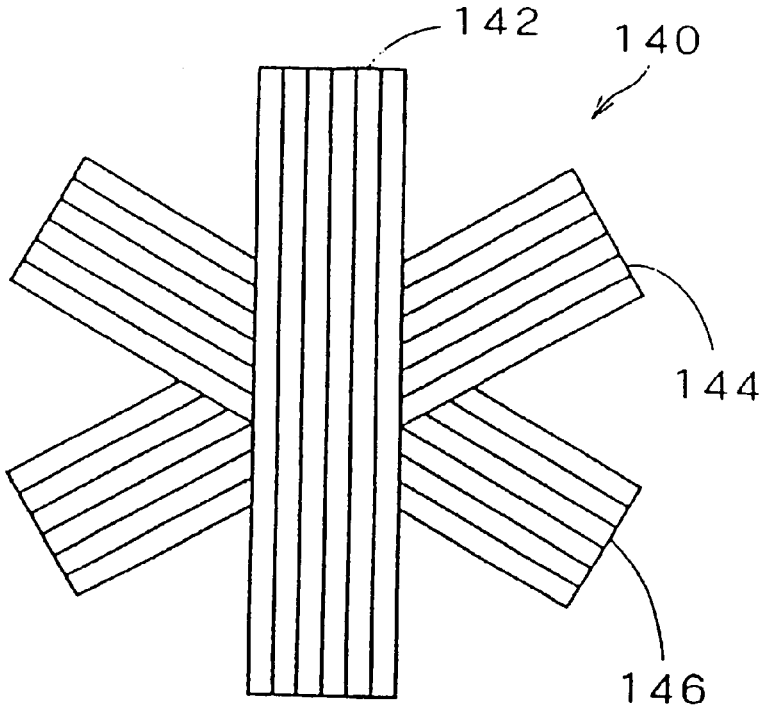
FIG. 17 is a plan view of a six-direction radial core section according to a second modification of the first embodiment.
Figure 18:
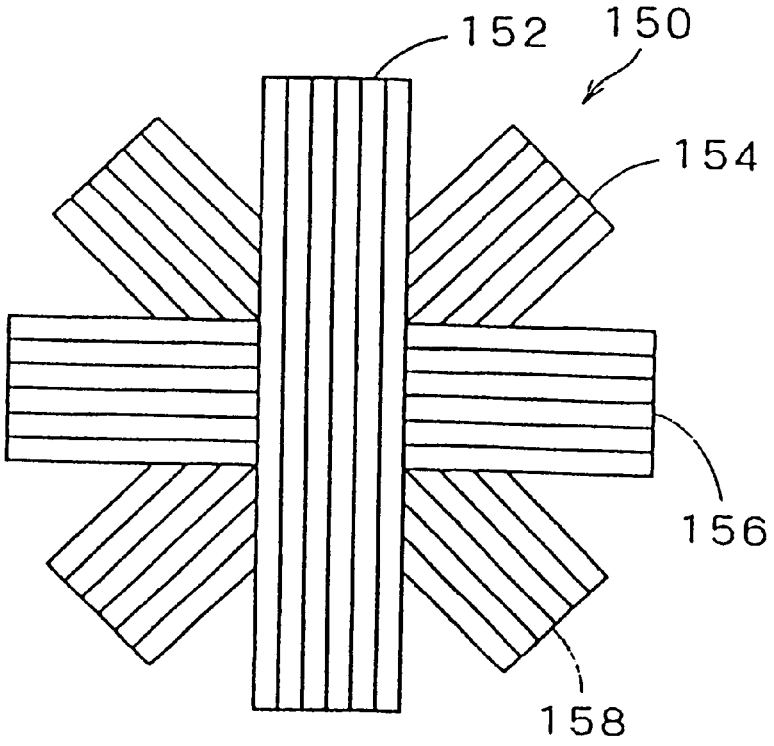
FIG. 18 is a plan view of an eight-direction radial core section according to a third modification of the first embodiment.

It is also possible to modify the above-described first embodiment as shown in FIGS. 17 and 18, which show second and third modifications, respectively, of the first embodiment. That is, three approximately core portions 142, 144, and 146 are combined with one another radially in six directions by intersecting them at middle portions thereof to form a six-direction radial core section 140. In the third modification shown in FIG. 18, four approximately core portions 152, 154, 156, and 158 are combined with one another radially in eight directions by intersecting them at middle portions thereof to form an eight-direction radial core section 150. In the case of the second and third modifications, a concave portion is selectively formed in some or all of the overlapping portions of the core portions 142, 144, 146, 152, 154, 156, and 158 to fit with the overlapping portions of respective other core portions 142, 144, 146, 152, 154, 156, and 158. In the second and third modifications, the height of each of the radial core sections 140 and 150 can be allowed to be small.

Figure 19:
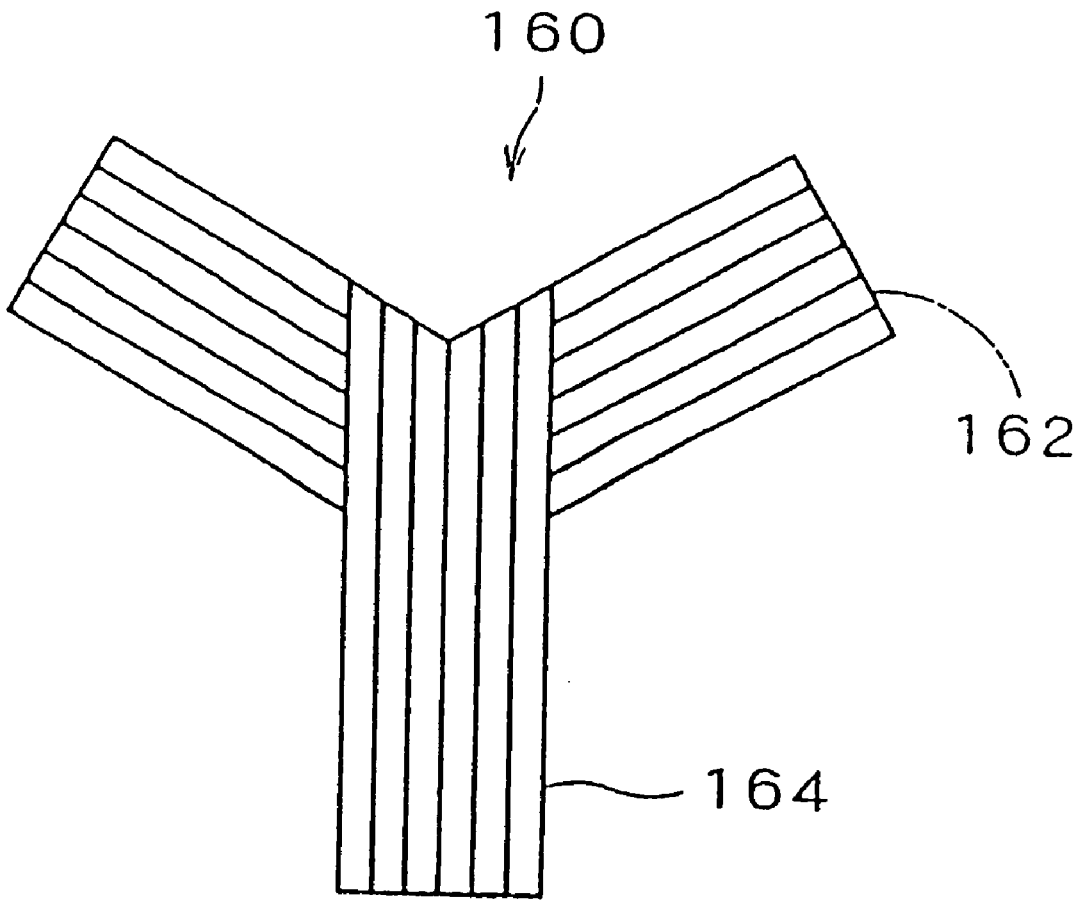
FIG. 19 is a plan view of a three-direction radial core section according to a fourth modification of the first embodiment.

In a fourth modification of the first embodiment of the present invention, shown in FIG. 19, a core portion 164 overlaps an apex of a core portion 162 approximately V-shaped in a plan view to form a three-direction radial core section 160. In this case, a concave portion is formed on the overlapping portion of the core portion 162 to fit the core portion 164. In the fourth modification, the height of the three-direction radial core section 160 can be allowed to be small.

In each of the modifications shown in FIGS. 17, 18 and 19, each of the core portions 142, 144, 146, 152, 154, 156, 158, 162, 164 is combined with a respective correspondingly shaped core portion (not shown) positioned on the opposite face of the coil member.

An ignition coil having the construction of the first embodiment was manufactured, and the performance thereof is shown in a table below in comparison with that of the conventional one.

The ignition coil according to the first embodiment of the present invention has a width of 63 mm, a depth of 63 mm, and a height of 20 mm in the state in which it is installed in the case 12. The coil 20 has a height of 10.5 mm and a width of 57–58 mm. The ratio of the height of the coil 20 to the width thereof is about 1:5–6 (preferably about 1:5.5).

Figure 20:
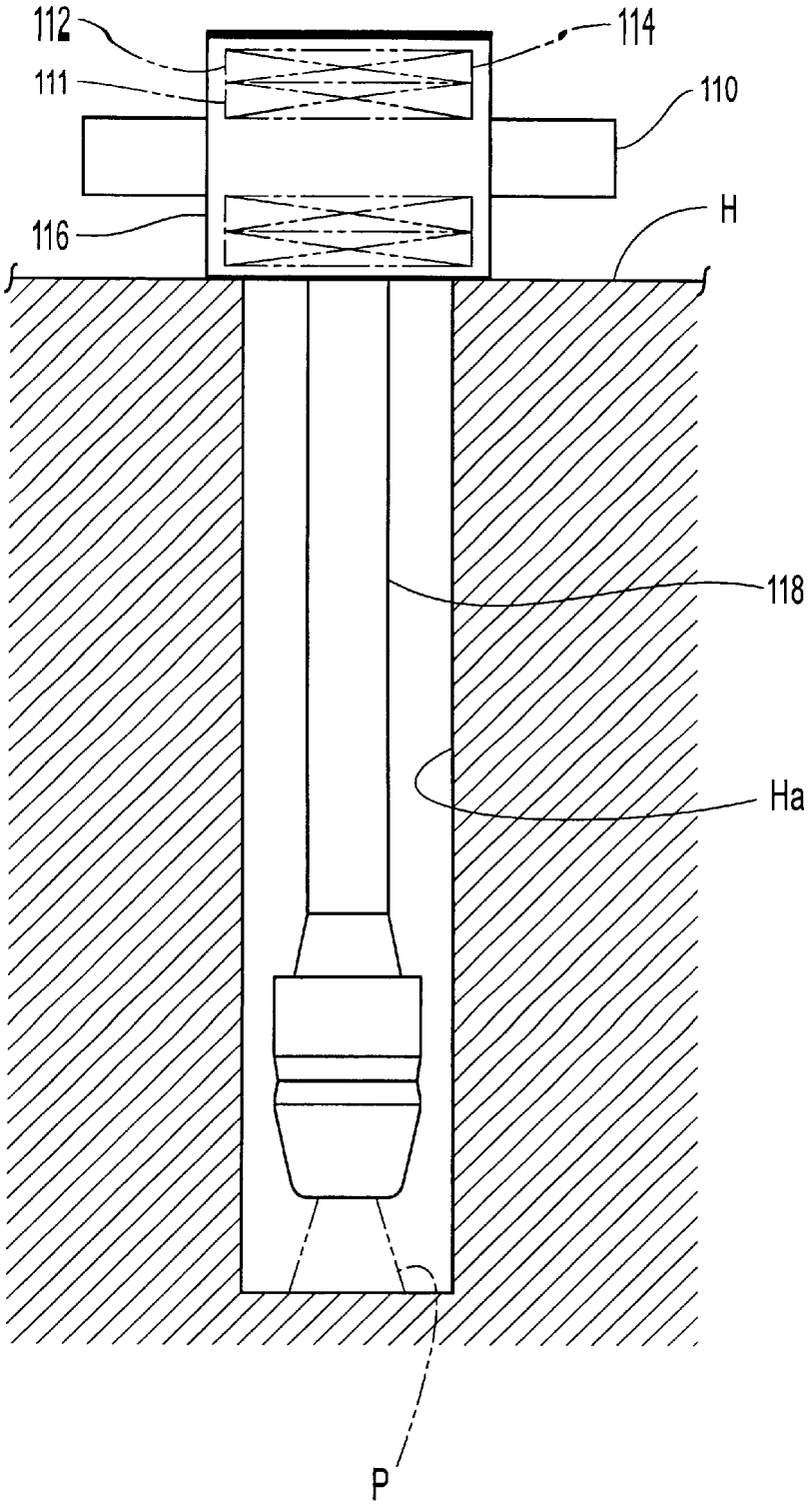
FIG. 20 PRIOR ART
FIG. 20 is a view of a conventional ignition coil in use.
Figure 21:
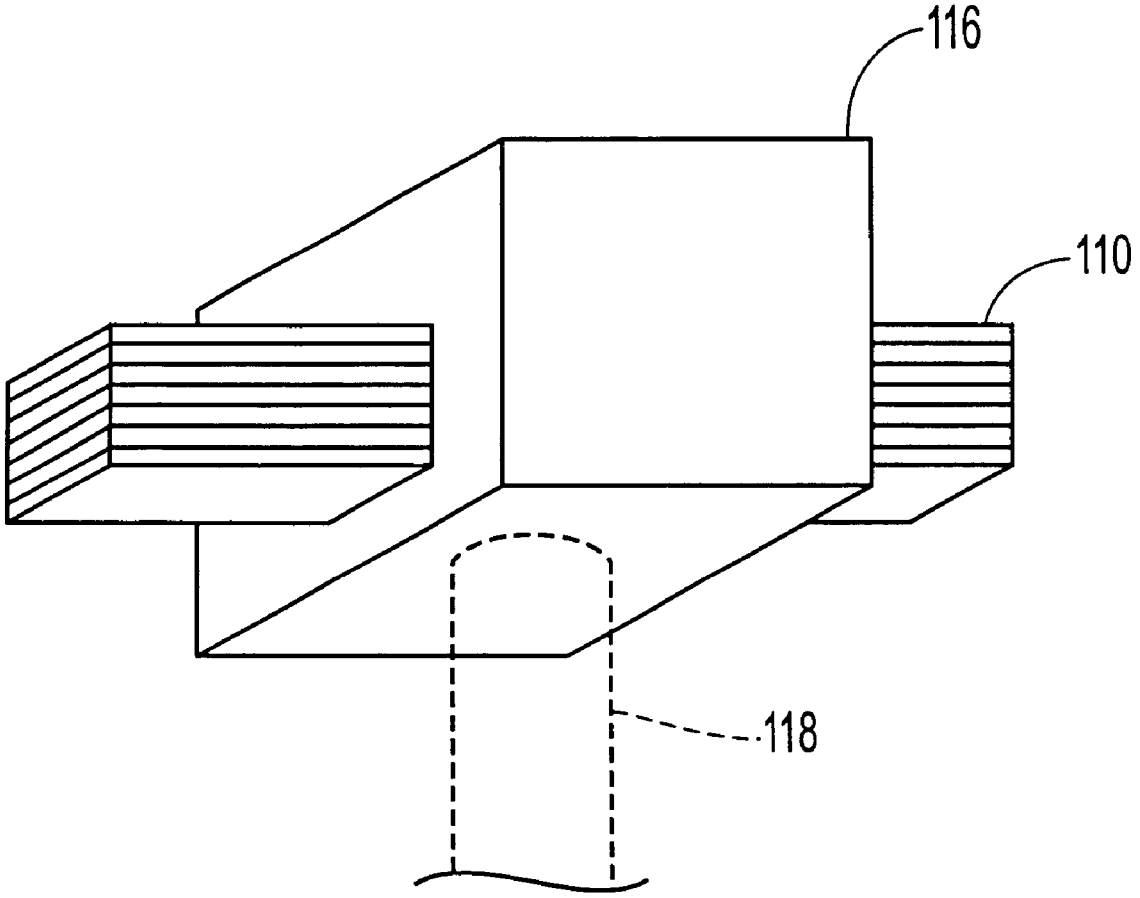
FIG. 21 PRIOR ART
FIG. 21 is a perspective view of the conventional ignition coil shown in FIG. 20.
Figure 22:
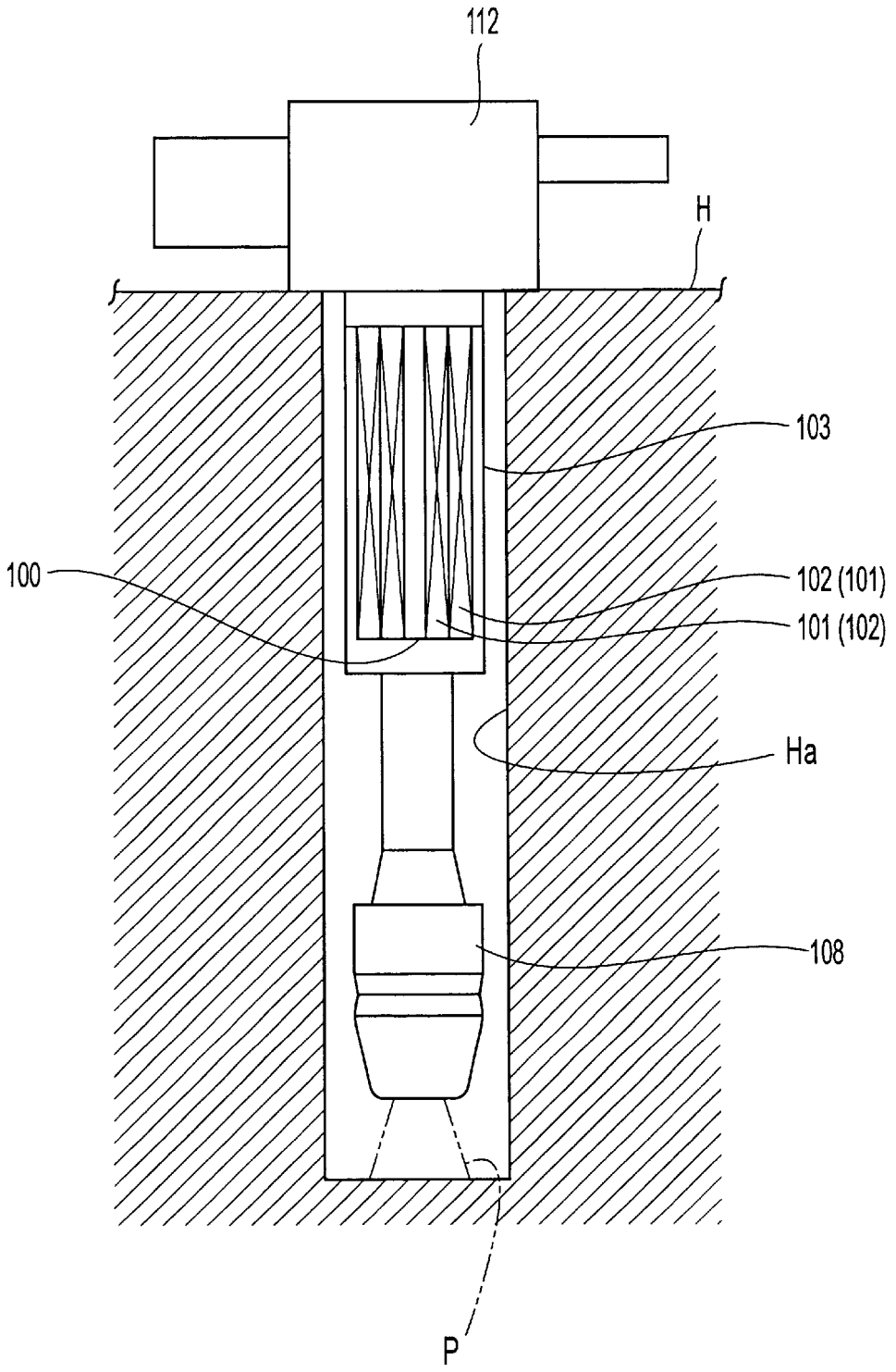
FIG. 22 PRIOR ART
FIG. 22 is a view of another conventional ignition coil in use.
Figure 23:
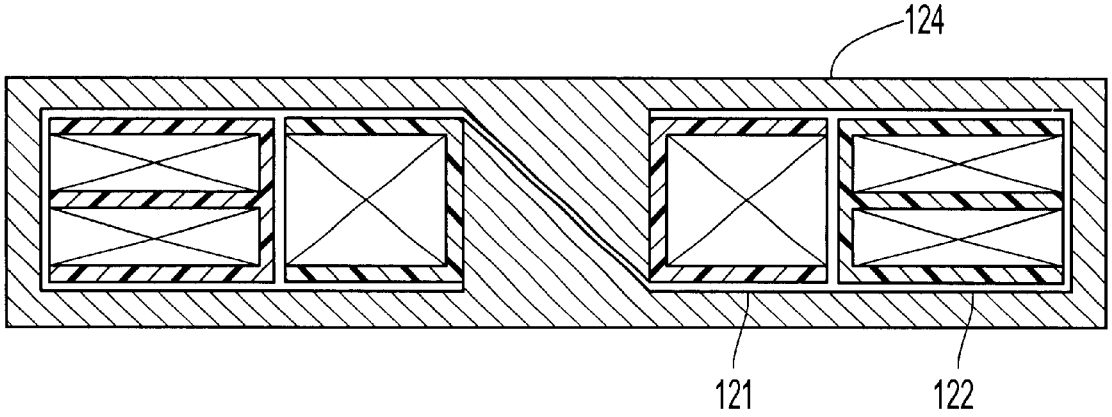
FIG. 23 is a sectional view of another ignition coil provided by the present applicant.

As ignition coils of comparative examples, the previously described conventional ignition coil shown in FIGS. 20 and 21 and the ignition coil provided with the coil 124 of a concentric type shown in FIG. 23 are used. The ignition coil shown in FIGS. 20 and 21 has a width of 78 mm, a depth of 56 mm, and a height of 46.3 mm. The ignition coil shown in FIG. 23 has a width of 71 mm, a depth of 71 mm, and a height of 20 mm. These dimensions were measured when the ignition coils were installed in each case.

The secondary voltage, the secondary energy, the secondary discharge time, and the secondary discharge current of the ignition coil shown in FIG. 23 and those of the ignition coil of the first embodiment shown in table 1 are ratios determined by setting those of the conventional ignition coil to 100.

TABLE 1

| | | Conventional ignition coil | Ignition coil of FIG. 23 | Ignition coil of the first embodiment |
|---|---|---|---|---|
| Portion | W (mm) | about 78 | 71 | 63 |
| | D (mm) | about 56 | 71 | 63 |
| | H (mm) | about 46.3 | 20 | 20 |
| Performance | Secondary voltage | 100% | 100% | 110% |
| | Secondary energy | 100% | 100% | 170% |
| | Secondary discharge time period | 100% | 100% | 130% |
| | Secondary discharge current | 100% | 100% | 130% |

In order for the ignition coil of the type shown in FIG. 23 to obtain performance higher than the conventional ignition coil shown in FIGS. 20 and 21, the former is required to have both a width and a depth more than 71 mm. That is, the ignition coil shown in FIG. 23 is larger in its radial direction.

As indicated in table 1, the ignition coil of the first embodiment is smaller than the conventional ignition coil shown in FIGS. 20 and 21 and yet has a higher performance than the conventional ignition coil.

The effect of the present invention is described below. As described above, the ignition coil for an internal combustion engine includes a flat coil member including an approximately disk-shaped primary coil section having a primary coil winding wound thereon and an approximately disk-shaped secondary coil section having a secondary coil winding wound thereon. The primary coil section and the secondary coil section face each other, with a core of each in alignment with a core of the other. Thus, it is possible to provide an ignition coil which has a small height, is prevented from interfering with adjacent ignition coils, and provides a sufficiently great secondary energy.

In the ignition coil for an internal combustion engine, a pair of radial core sections, each being formed of a plurality of core portions having an overlapping portion at a center thereof, are combined with each other so as to extend radially. The radial core sections are installed on upper and lower sides of the coil member such that the coil member is sandwiched between the pair of radial core sections to form a plurality of magnetic paths passing from a center of the coil member to a periphery thereof. In this construction, it is possible to obtain a larger secondary energy owing to the closed magnetic paths. In this case, a concave portion is formed on the overlapping portion of at least one of the core portions to fit the overlapping portion of one of the core portions thereinto. This construction allows the overlapping portion of the mating core portions to be thin, which contributes to reduction of the height of the entire ignition coil.

In the ignition coil, the coil member having the radial core sections installed thereon is accommodated inside a case member and fixed thereto by insulation resin charged thereinto by injection. This construction ensures insulation between adjacent layers of the coil winding.

In the ignition coil, the primary coil section and the secondary coil section face each other, so as to expose a surface of the primary coil section opposite to a surface thereof facing the secondary coil section. In this construction, insulation resin is charged by injection into the case member, with one or more insulation spacers interposed between an exposed surface of the primary coil section and at least one of the core portions of the radial core sections facing the exposed surface. Consequently, the insulation resin is injected into the space between the exposed surface of the primary coil section and the core portion, with a sufficient insulation distance secured therebetween by the insulation spacers. Thus, the space between the primary coil section and the cross core section has sufficient electrical insulation performance.

Preferably, the case member is vibrated when insulation resin is injected into the case member accommodating a coil member having radial core sections installed thereon. This method allows the insulation resin to easily penetrate into the layers of the coil winding of the secondary coil section, thus providing insulation in the gap between adjacent layers of the coil winding. That is, this method allows the insulation resin to easily penetrate into very narrow spaces, thus shortening the insulation resin-charging time period and facilitating the resin-charging operation.

An ignition coil device having an ignition coil for an internal combustion engine according to a second embodiment of the present invention will now be described.

Figure 24:
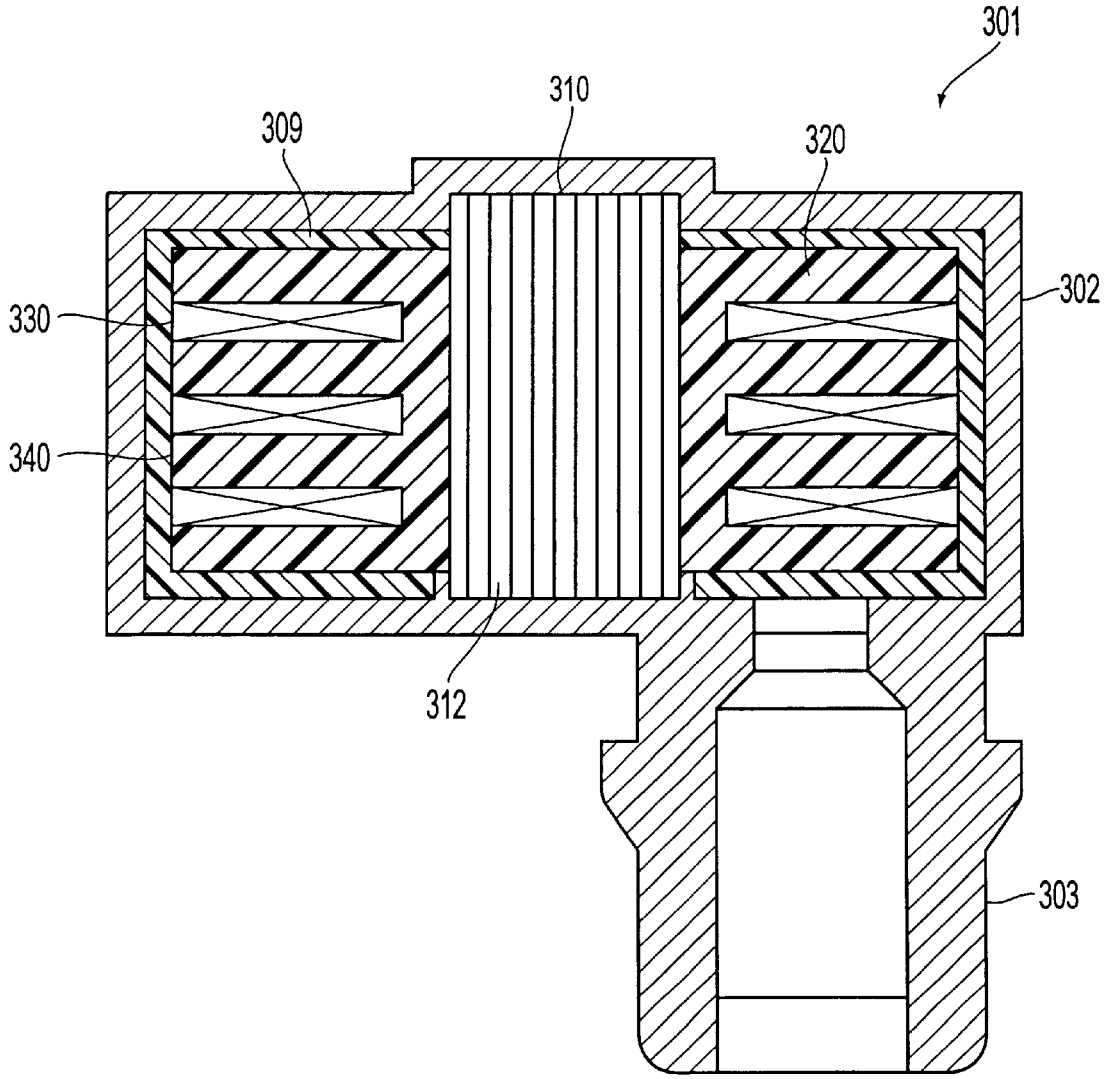
FIG. 24 is a sectional view showing an ignition coil device according to a second embodiment of the present invention.

The ignition coil device is of an independent ignition type. In other words, an ignition coil device is provided for each cylinder of an internal combustion engine. As shown in FIG. 24, heat-hardening resin 309 is injected into a case 301 accommodating an ignition coil 310.

The case 301 includes a connection section 303 extending downward from one side of the lower surface of an accommodating section 302 accommodating the ignition coil 310. The connection section 303 is inserted into a plug hole of the internal combustion engine (not shown) to connect the ignition coil 310 with an ignition plug positioned at the bottom of the plug hole.

The ignition coil 310 includes a column-shaped short magnetic core 312, a bobbin 320 installed around the magnetic core 312, and a coil winding wound on the bobbin 320 to form a primary coil section 330 and a secondary coil section 340.

Figure 25:
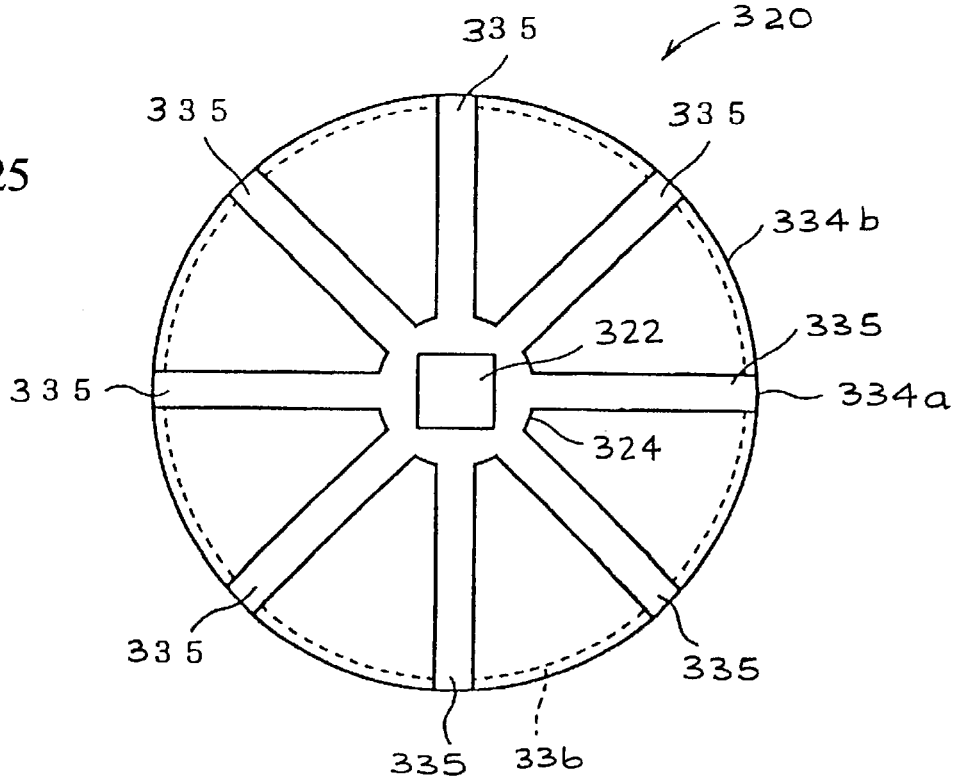
FIG. 25 is a plan view of a bobbin of the embodiment of FIG. 24.
Figure 26:
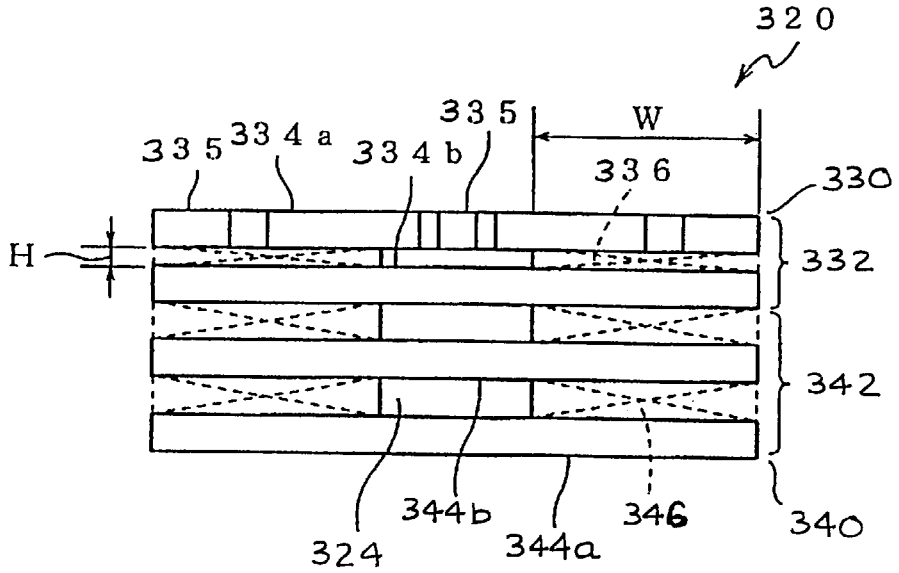
FIG. 26 is a front view showing the bobbin of FIG. 25.

The bobbin 320 is formed of a material such as polybutylene terephthalate (PBT) which is superior in heat-resistance and electrical characteristics. As shown in FIGS. 25 to 26, the bobbin 320 includes a primary coil winding seat 332 formed in an upper part of a winding core 324 having a magnetic core-insertion hole 322 formed on its axis to insert a magnetic core 312 thereinto; and a secondary coil winding seat 342 formed in a lower part of the winding core 324. The primary coil winding seat 332 and the secondary coil winding seat 342 adjacent thereto in series are formed by one-piece moulding.

The primary coil winding seat 332 includes a pair of parallel flange portions, namely, an upper flange portion 334*a* (see FIG. 25) radially extended from the winding core 324 and a disk-shaped lower flange portion 334*b* spaced vertically at a predetermined interval from the upper flange portion 334*a*. A primary coil winding 350 (see FIG. 27) is wound between the upper flange portion 334*a* and the lower flange portion 334*b* to form the primary coil section 330.

Figure 27:
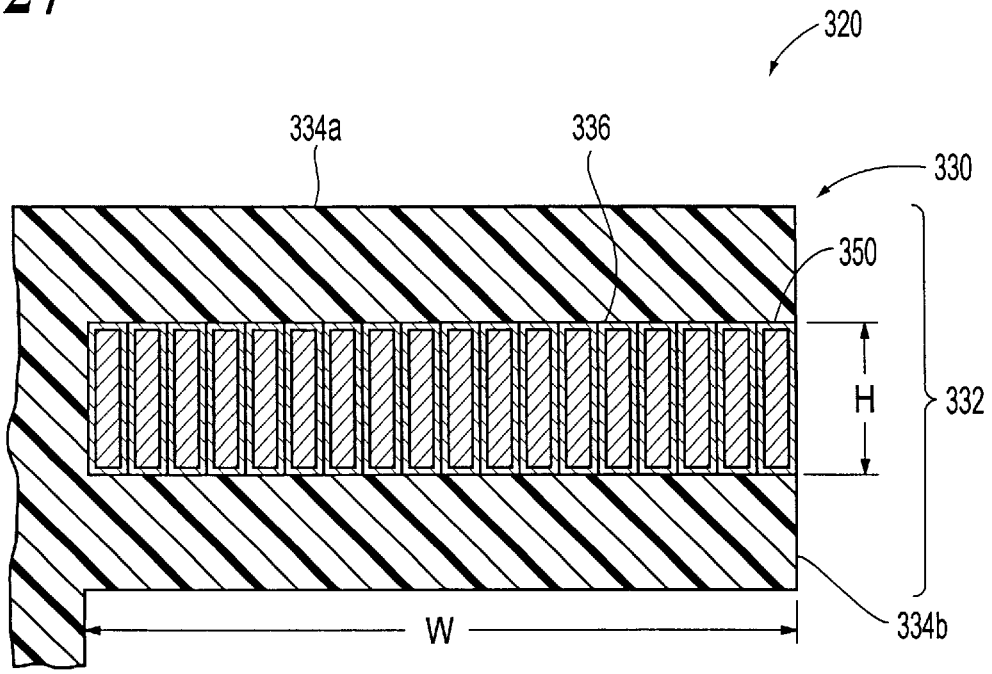
FIG. 27 is an enlarged sectional view showing main parts of the bobbin of FIG. 25 and a coil winding wound around the bobbin.
Figure 28:
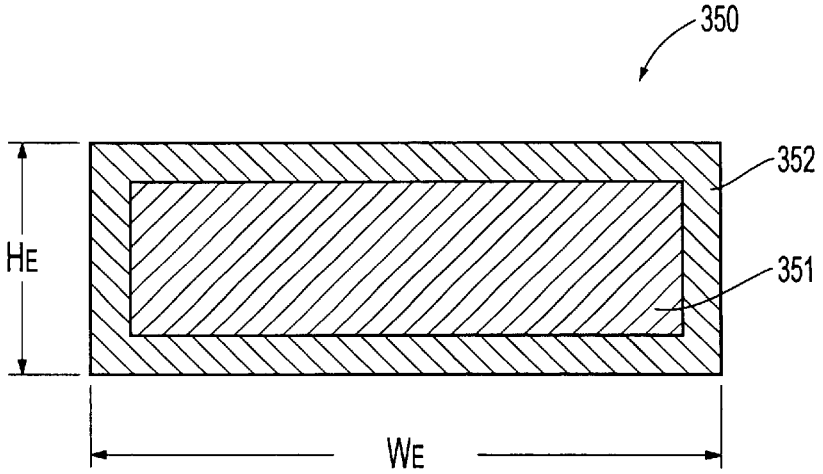
FIG. 28 is a sectional view showing a primary coil winding of FIG. 27.

As shown in FIGS. 27 and 28, the primary coil winding 350 is a sectionally rectangular enamel wire formed by applying enamel paint 352 to the surface of a belt-shaped linear copper wire 351. The width $W_E$ of the primary coil winding 350 is set to be almost equal to the interval H between the upper and lower flange portions 334*a* and 334*b*. The primary coil winding 350 is wound 80 times between the upper and lower flange portions 334*a* and 334*b* of the primary coil winding seat 332 such that the primary coil winding 350 is wound upon itself in the thickness direction thereof to form a flat ring-shaped primary coil winding part 336. Incidentally, FIG. 27 is schematic in that it shows a primary coil winding 350 which is wound a smaller number of times than the number of times it would be wound in typical embodiments.

The respective dimensions of the primary coil winding part 336 are set as described below. The interval H between the upper and lower flange portions 334*a* and 334*b* is set to 2 mm. The interval W between the peripheral surface of the winding core 324 and the peripheral edge of each of the upper and lower flange portions 334*a* and 334*b* is set to 8 mm. The width $W_E$ of the primary coil winding 350 is set to be about equal to the interval H =2 mm between the upper and lower flange portions 334*a* and 334*b*. The thickness $H_E$ of the primary coil winding 350 is set to 0.1 mm. The primary coil winding 350 replaces the 0.5 mm diameter enamel wire used as the primary coil winding 410 of the conventional ignition coil shown in FIGS. 31 and 32.

Referring to FIGS. 25 and 26, the upper flange portion 334*a* includes eight elongate portions 335 extending radially from the winding core 324 such that the eight elongate portions 335 are spaced at regular intervals circumferentially. The upper surface of the primary coil winding part 336 is exposed through spaces formed between the adjacent extended portions 335 of the upper flange portion 334*a*.

At the lower end of the secondary coil winding seat 342, a disk-shaped flange portion 344*a* extends radially from the winding core 324. At the position vertically midway between the flange portion 344*a* and the lower flange portion 334*b*, a disk-shaped partitioning flange portion 344*b* extends radially from the winding core 324. The partitioning flange portion 344*b* partitions the secondary coil winding seat 342 (which extends from the lower flange portion 334*b* to the flange portion 344*a*) into two regions.

A secondary coil winding made of an enamel wire is fillingly wound between the flange portion 344*a* of the secondary coil winding seat 342 and the flange portion 344*b* thereof and between the flange portion 344*b* and the lower flange portion 334*b* to form a secondary coil section 340 and a secondary coil winding part 346.

Coil winding to be used as the secondary coil winding part 346 may be circular in section and have a diameter of 0.05 mm–0.06 mm, for example. The coil winding is wound approximately 12,000 times, for example, around the secondary coil winding seat 342 to form the secondary coil winding part 346.

In the ignition coil device thus constructed, the primary coil winding 350 to be wound on the primary coil winding seat 332 is enamel wire which is belt-shaped and linear and has a width $W_E$ substantially equal to the interval H between the upper and lower flange portions 334*a* and 334*b*. The primary coil winding 350 is wound closely on the primary coil winding seat 332, thereby allowing the primary coil section 330 to be compact and thus allowing the ignition coil 310 to be compact.

Figure 31:
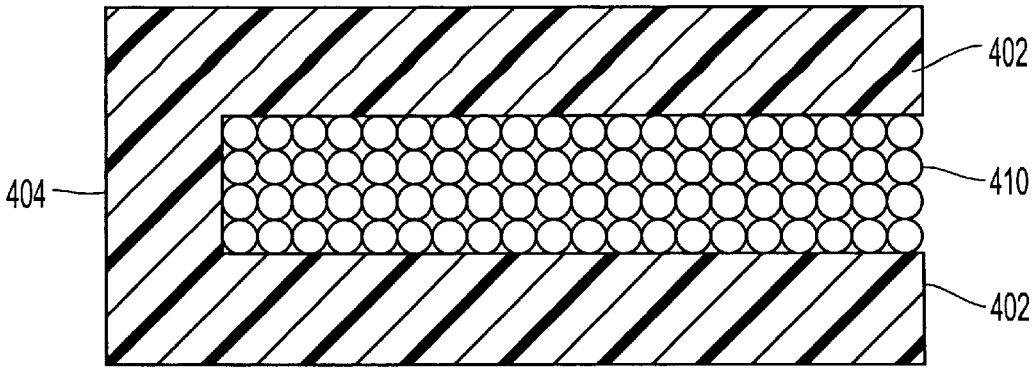
FIG. 31 PRIOR ART
FIG. 31 is a sectional view showing a conventional method of winding an enamel wire on a coil winding seat.
Figure 32:
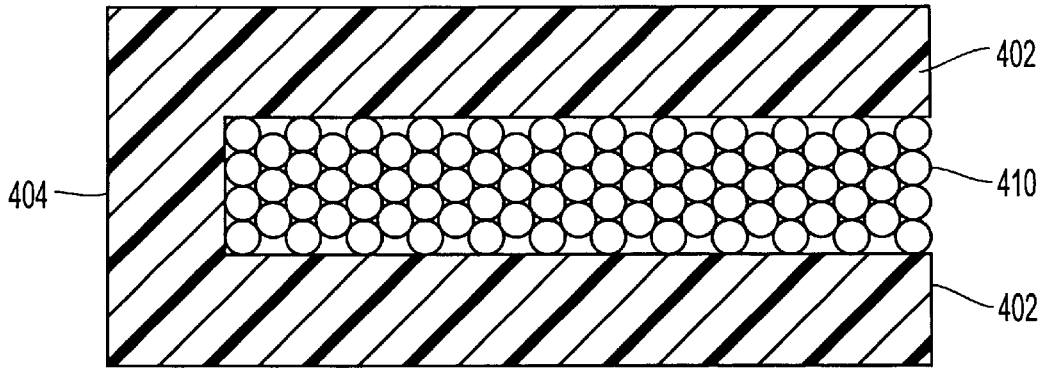
FIG. 32 PRIOR ART
FIG. 32 is a sectional view showing another conventional method of winding an enamel wire on a coil winding seat.

More specifically, in the primary coil section shown in FIG. 31, a ring-shaped space having a cross-sectional area of $0.5\times0.5\times80=20\ mm^2$ is required between the upper and lower flange portions 402 and 402 to accommodate the coil. By contrast, in the primary coil section 330 shown in FIG. 27, a ring-shaped space having a cross-sectional area of $0.1\times2\times80=16\ mm^2$ is required between the upper and lower flange portions 334*a* and 334*b*. Thus, the primary coil section 330 can be smaller than the primary coil section of the conventional ignition coil by about 20%.

Each round of the primary coil winding 350 contacts an adjacent round of the primary coil winding 350 closely. Thus, during use of the ignition coil device in an internal combustion engine, heat generated in the primary coil winding part 336 is efficiently transmitted in the radial direction via the turns of the primary coil winding 350. That is, the ignition coil has superior heat-radiating performance. Further, because the heat generated in the primary coil section 330 can be dispersed efficiently, it is possible to prevent the heat from being transmitted to the secondary coil section 340 and thus improve the durability of the ignition coil.

The upper flange portion 334*a* of the primary coil section 330 is so shaped that the upper surface of the primary coil winding part 336 is exposed through the spaces between adjacent extended portions 335 of the upper flange portion 334*a*. Thus, dispersion of the heat generated in the primary coil section 330 is not prevented by the upper flange portion 334*a* but can be accomplished efficiently from the spaces between adjacent extended portions 335. Thus, the primary coil section 330 has superior heat-radiating performance.

Further, because the primary coil section 330 is located above the secondary coil section 340, a large heat-radiating space is provided over the primary coil section 330 when the ignition coil device is installed in an internal combustion engine. Accordingly, the heat generated in the primary coil section 330 can be efficiently dispersed to the space over the primary coil section 330. Thus, the primary coil section 330 has excellent heat-radiating performance, so that the secondary coil section 340 can be prevented from being damaged by heat generated in the primary coil section 330.

The configuration of the upper flange portion of the bobbin 320 is not limited to that of the embodiment illustrated in FIG. 25, but may be any shape, provided that the primary coil winding part 336 is at least partially exposed through the upper flange portion.

Figure 29:
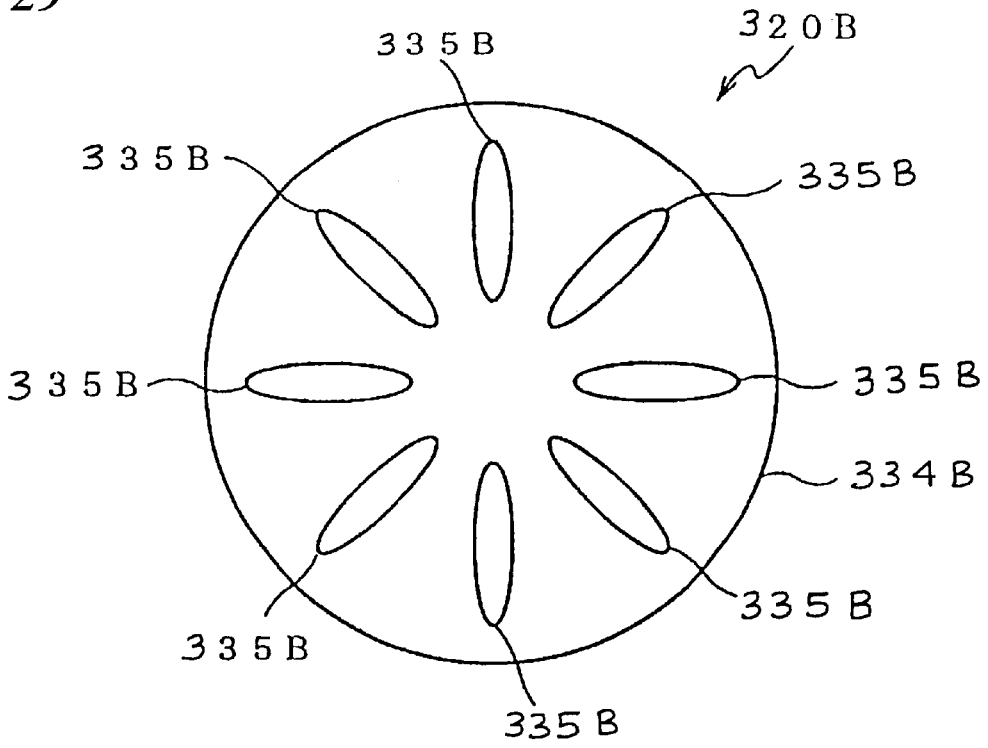
FIG. 29 is a plan view showing a modification of the bobbin shown in FIG. 27.

For example, as shown in FIG. 29, it is possible to form a disk-shaped flange portion 334B on a bobbin 320B including a plurality of slot-shaped heat-radiating holes 335B extending radially across the contact portion between the flange portion 334B and the primary coil winding section 336.

Figure 30:
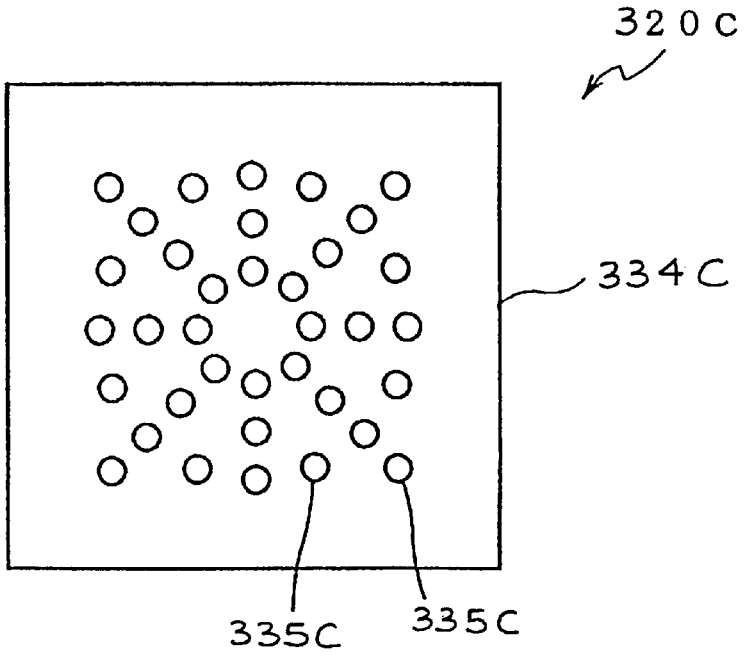
FIG. 30 is a plan view showing another modification of the bobbin shown in FIG. 27.

As another example, as shown in FIG. 30, it is possible to form a flange portion 334C which is substantially square in plan view, for example, on a bobbin 320C which is also substantially square, for example, and to form a plurality of small heat-radiating holes 335C in the portion of the flange portion 334C which contacts the primary coil winding part 336. The heat-radiating holes 335C may be circular or any other desired shape.

Similarly to the embodiment of FIG. 25, in the flange portions 334B and 334C shown in each of FIGS. 29 and 30, heat generated in the primary coil winding part 336 can be dispersed efficiently from the heat-radiating holes 335B and the heat-radiating holes 335C, respectively.

Further, the secondary coil section 340 may have a construction similar to that of the primary coil section 330. That is, a pair of flange portions may be formed on the secondary coil winding seat 342, and a secondary coil winding of a linear belt-shaped enamel wire having a width almost equal to the interval between the pair of flange portions may be wound therebetween. In this case, it is preferable to use a coil winding in which the ratio between the thickness and the width is 1:15–1:30 and wind it 10,000–15,000 times between the pair of flange portions.

To reiterate, in an ignition coil for an internal combustion engine according to the second embodiment of the invention, the coil winding is linear and belt-shaped, has a width substantially equal to an interval between a pair of flange portions and is wound upon itself around the coil winding seat. Accordingly, the coil winding is wound closely, with each round thereof in close contact with an adjacent round thereof, which allows the ignition coil to be compact. Further, because the coil winding is wound in this way, heat generated in the coil winding can be easily radiated to the outside. Thus, the ignition coil has superior heat-radiating performance.

Also as described above, at least one of the pair of flange portions is so shaped that the coil winding wound on the coil winding seat (in particular a portion of the winding facing in the spacing direction of the flange portions)is exposed. Thus, heat can be radiated efficiently from the exposed portion of the coil winding.

While the invention has been described in conjunction with the specific embodiments described above, many equivalent alternatives, modifications and variations will become apparent to those skilled in the art once given this disclosure. Accordingly, the preferred embodiments of the invention as set forth above are considered to be illustrative and not limiting. Various changes to the described embodiments may be made without departing from the spirit and scope of the invention.

What is claimed is:

1. An internal combustion engine ignition coil that attaches to a receiving opening in an internal combustion engine, comprising:

a coil assembly, the coil assembly comprising (i) a primary coil section including a primary coil winding and (ii) a secondary coil section including a secondary coil winding, said primary coil section and said secondary coil section facing each other, a winding axis of said primary coil section being aligned with a winding axis of said secondary coil section, and the coil assembly having a height of 10 mm to 25 mm; and an elongate connection section that connects with the receiving opening in the internal combustion engine, the elongate connection section fixed relative to the coil assembly and extending from the coil assembly in a direction parallel to the winding axis of the primary coil winding and the winding axis of the secondary coil winding, wherein radial core sections, each formed of a plurality of mutually intersecting core portions, are provided, one of the radial core sections being installed over an upper face of said coil assembly and another of the radial core sections being installed under a lower face of said coil assembly, such that said coil assembly is between the radial core sections, said core portions being configured such that the core portions of one of said radial core sections contact the core portions of another of said radial core sections to form a plurality of magnetic paths passing from a center of said coil assembly to a periphery thereof; and a concave portion is formed in at least one of said core portions to receive an overlapping portion of at least another of said core portions at a point where said core portions intersect, the core portions all having a same thickness in the direction of the winding axis of said primary coil section and the winding axis of said secondary coil section, and top and bottom surfaces of each core portion being co-planar with top and bottom surfaces of each other core portion.

2. The internal combustion engine ignition coil according to claim 1, wherein said coil assembly is accommodated inside a case member and fixed thereto by insulation resin that fills a space between the coil assembly and the case member.

3. An internal combustion engine ignition coil that attaches to a receiving opening in an internal combustion engine, comprising:

a coil assembly, the coil assembly comprising (i) a primary coil section including a primary coil winding and (ii) a secondary coil section including a secondary coil winding, said primary coil section and said secondary coil section facing each other, a winding axis of said primary coil section being aligned with a winding axis of said secondary coil section, and the coil assembly having a height of 10 mm to 25 mm; and an elongate connection section that connects with the receiving opening in the internal combustion engine, the elongate connection section fixed relative to the coil assembly and extending from the coil assembly in a direction parallel to the winding axis of the primary coil winding and the winding axis of the secondary coil winding, wherein radial core sections, each formed of a plurality of mutually intersecting core portions, are provided, one of the radial core sections being installed over an upper face of said coil assembly and another of the radial core sections being installed under a lower face of said coil assembly, such that said coil assembly is between the radial core sections, said core portions being configured such that the core portions of one of said radial core sections contact the core portions of another of said radial core sections to form a plurality of magnetic paths passing from a center of said coil assembly to a periphery thereof; and a concave portion is formed in at least one of said core portions to receive an overlapping portion of at least another of said core portions at a point where said core portions intersect, the core portions all having a same thickness in the direction of the winding axis of said primary coil section and the winding axis of said secondary coil section, and top and bottom surfaces of each core portion being co-planar with top and bottom surfaces of each other core portion, wherein said coil assembly is accommodated inside a case member and fixed thereto by insulation resin that fills a space between the coil assembly and the case member; and further comprising one or more insulation spacers interposed between said primary coil section and at least one of said core portions of at least one of said radial core sections, the one or more spacers covering an area of said primary coil section that is less than an area of said primary coil section covered by the core portions, and directly contacting the primary coil section and the core portion, said one or more insulation spacers maintaining a space between the primary coil section and said at least one of the radial core sections, and said space between the primary coil section and said at least one of the radial core sections being occupied by said insulation resin.

4. A method of manufacturing the ignition coil for an internal combustion engine ignition coil described in claim 2, wherein the case member is vibrated when the insulation resin is put into said case member accommodating the coil member having the radial core sections installed thereon.

5. An ignition coil that attaches to a receiving opening in an internal combustion engine, comprising:

a coil assembly, the coil assembly comprising a primary coil winding and a secondary coil winding; and an elongate connection section that connects with the receiving opening in the internal combustion engine, the elongate connection section fixed relative to the coil assembly and extending from the coil assembly in a direction parallel to a winding axis of the primary coil winding and a winding axis of the secondary coil winding;

wherein radial core sections, identical in configuration and each formed of a plurality of mutually intersecting core portions, are provided, one of the radial core sections being installed over an upper face of the coil assembly and another of the radial core sections being installed under a lower face of the coil assembly, such that the coil assembly is between the radial core sections, said core portions being configured such that the core portions of one of said radial core sections contact the core portions of another of said radial core sections to form a plurality of magnetic paths passing from a center of said coil assembly to a periphery thereof; and a concave portion is formed in at least one of said core portions to receive an overlapping portion of at least another of said core portions at a point where said core portions intersect, the core portions all having a same thickness in the direction of the winding axis of said primary coil section and the winding axis of said secondary coil section, and top and bottom surfaces of each core portion being co-planar with top and bottom surfaces of each other core portion;

a case member that accommodates the coil assembly;

one or more insulation spacers interposed between said primary coil section and at least one of said core portions of at least one of said radial core sections, the one or more spacers covering an area of said primary coil section that is less than an area of said primary coil section covered by the core portion and directly contacting the primary coil section and the core portion, said one or more insulation spacers maintaining a space between the primary coil section and said one of said radial core sections; and insulation resin occupying said space maintained by said one or more insulation spacers.

* * * * *